US010575075B2

(12) United States Patent
Arevalo Carreno et al.

(10) Patent No.: US 10,575,075 B2
(45) Date of Patent: Feb. 25, 2020

(54) PIEZOELECTRIC ARRAY ELEMENTS FOR SOUND RECONSTRUCTION WITH A DIGITAL INPUT

(71) Applicant: KING ABDULLAH UNIVERSITY OF SCIENCE AND TECHNOLOGY, Thuwal (SA)

(72) Inventors: Armando Arpys Arevalo Carreno, Cheshire (GB); David Conchouso Gonzalez, Thuwal (SA); David Castro Signoret, Thuwal (SA); Ian G. Foulds, Thuwal (SA)

(73) Assignee: KING ABDULLAH UNIVERSITY OF SCIENCE AND TECHNOLOGY, Thuwal (SA)

( * ) Notice: Subject to any disclaimer, the term of this patent is extended or adjusted under 35 U.S.C. 154(b) by 0 days.

(21) Appl. No.: 16/400,776

(22) Filed: May 1, 2019

(65) Prior Publication Data

US 2019/0261074 A1 Aug. 22, 2019

Related U.S. Application Data

(62) Division of application No. 15/563,829, filed as application No. PCT/IB2016/051986 on Apr. 7, 2016, now Pat. No. 10,327,052.

(Continued)

(51) Int. Cl.
*H04R 1/00* (2006.01)
*H04R 31/00* (2006.01)

(Continued)

(52) U.S. Cl.
CPC ..... *H04R 1/005* (2013.01); *H04R 1/02* (2013.01); *H04R 17/005* (2013.01); *H04R 31/00* (2013.01);

(Continued)

(58) Field of Classification Search
CPC ..... H04R 1/24; H04R 2201/003; H04R 2201/029; H04R 2217/01; H04R 2217/03;

(Continued)

(56) References Cited

U.S. PATENT DOCUMENTS

2010/0307150 A1 12/2010 Wu et al.
2012/0169185 A1* 7/2012 Harris ..... H04R 31/006 310/12.16

(Continued)

FOREIGN PATENT DOCUMENTS

WO 2008052306 A1 5/2008
WO WO-2016029357 A1 * 3/2016 ..... H04R 19/013

OTHER PUBLICATIONS

Afanasjev, V.P., et al., "Polarization and Self-Polarization in Thin PbZr1—xTixO3 (PZT) Films," Journal of Physics: Condensed Matter, 2001, vol. 13, No. 39, pp. 8755-8763.

(Continued)

*Primary Examiner* — Fan S Tsang
*Assistant Examiner* — Julie X Dang
(74) *Attorney, Agent, or Firm* — Patent Portfolio Builders PLLC

(57) ABSTRACT

Various examples are provided for digital sound reconstruction using piezoelectric array elements. In one example, a digital loudspeaker includes a fixed frame and an array of transducers disposed on the fixed frame. Individual transducers of the array of transducers can include a flexible membrane disposed on a piezoelectric actuation element positioned over a corresponding opening that extends through the fixed frame. In another example, a method includes forming a flexible membrane structure on a substrate and backetching the substrate opposite the flexible membrane structure. The flexible membrane structure can be formed by disposing a first electrode layer on a substrate, (Continued)

disposing a piezoelectric layer on the first electrode layer and disposing a second electrode layer on the piezoelectric layer. A flexible membrane layer (e.g., polyimide) can be disposed on the second electrode layer.

20 Claims, 24 Drawing Sheets

Related U.S. Application Data

(60) Provisional application No. 62/144,502, filed on Apr. 8, 2015.

(51) Int. Cl.
*H04R 1/02* (2006.01)
*H04R 17/00* (2006.01)

(52) U.S. Cl.
CPC ..... *H04R 31/006* (2013.01); *H04R 17/00* (2013.01); *H04R 2201/003* (2013.01)

(58) Field of Classification Search
CPC ..... H04R 2307/023; H04R 2400/11; H04R 2440/05
USPC ..... 381/182, 190, 191, 104; 310/12.16, 311
See application file for complete search history.

(56) References Cited

U.S. PATENT DOCUMENTS

| | | | | |
|---|---|---|---|---|
| 2013/0043766 | A1 | 2/2013 | Takahashi et al. | |
| 2013/0121509 | A1* | 5/2013 | Hsu | H04R 19/005 381/104 |
| 2013/0294636 | A1 | 11/2013 | Cassett et al. | |
| 2016/0284977 | A1* | 9/2016 | Tanimoto | C08G 63/06 |
| 2018/0139542 | A1* | 5/2018 | Zou | H04R 17/00 |

OTHER PUBLICATIONS

Alfadhel, A, et al., "Three-Axis Magnetic Field Induction Sensor Realized on Buckled Cantilever Plate," IEEE Transactions on Magnetics, Jul. 2013, vol. 49, No. 7, pp. 4144-4147.
Arevalo, A. et al., "Simulation of a Polyimide Based Micromirror," Proceedings of the 2014 COMSOL Conference, Boston, Massachusetts, 2014.
Arevalo, A., et al., "MEMS Acoustic Pixel," Proceedings of the 2014 COMSOL Conference, Cambridge, England, 2014.
Arevalo, A., et al., "Parametric Study of Polyimide-Lead Zirconate Titanate Thin Film Cantilevers for Transducer Applications," Proceedings of the 2013 COMSOL Conference, Rotterdam, Holland, 2013.
Arevalo, A., et al., "Platform Isolation Using Out-of-Plane Compliant Mechanisms," Proceedings of the 2014 COMSOL Conference, Boston, Massachusetts, Aug. 2014.
Arevalo, A., et al., "Polyimide Thermal Micro Actuator," Proceedings of the 2014 COMSOL Conference, Cambridge, England, 2014.
Carreno, A.A., et al., "Optimized Cantilever-to-Anchor Configurations of Buckled Cantilever Plate Structures for Transducer Applications," Proceedings of the 2012 COMSOL, Milan, 2012.
Carreno, A.A., et al., "μHeater on a Buckled Cantilever Plate for Gas Sensor Applications," Proceedings of the 2012 COMSOL Conference in Milan, Oct. 2012.
Castro, D., et al., "Simulation of a Micro-Scale Out-of-Plane Compliant Mechanism," Proceedings of the 2014 COMSOL Conference, Cambridge, England, 2014.
Cho, I-J., et al., "A Piezoelectrically Actuated MEMS Speaker with Polyimide Membrane and Thin Film Pb(Zr,Ti)O3 (PZT) Actuator," Integrated Ferroelectrics, Aug. 2009, vol. 105, No. 1, pp. 27-36.
Choe, Y., et al. "High Fidelity Loud Microspeaker Based on PZT Bimorph Diaphragm," Nanotechnology 2010: Electronics, Devices, Fabrication, Mems, Fluidics and Computational—Technical Proceedings of the 2010 Nsti Nanotechnology Conference and Expo, Nsti-Nanotech, 2010, vol. 2, pp. 316-319.
Conchouso, D., et al., "Simulation of SU-8 Frequency-Driven Scratch Drive Actuators," UKSim, 15th International Conference on Computer Modelling and Simulation, Jun. 2013, pp. 803-808.
Diamond, B.M., et al., "Digital Sound Reconstruction Using Arrays of CMOS-MEMS microspeakers," 2002, The Fifteenth IEEE International Conference on Micro Electro Mechanical System, pp. 292-295.
Fan, Y., et al., "Low-Cost Silicon Wafer Dicing Using a Craft Cutter," Microsystem Technologies, 2015, vol. 21, pp. 1411-1414.
First Examination Report in corresponding/related GC Application No. 2016-31133, dated Feb. 20, 2019 (References D1 and D3 were cited cited in the IDS filed Oct. 2, 2017 and Reference D2 was cited in the Office Action dated Aug. 30, 2018).
Hawksford, M., "Spatial Distribution of Distortion and Spectrally-shaped Quantization Noise in Digital Micro-Array Loudspeakers," Audio Engineering Society 120th Convention, 2006.
Hawksford, M.O.J., "Smart Digital Loudspeaker Arrays," J. Audio Eng. Soc, Dec. 2003, vol. 51, No. 12, pp. 1133-1162.
Hong, E., et al., "Fabrication of Piezoelectric Diaphragm Using Lead Zirconate Titanate (PZT) Films," Materials Science of Microelectromechanical Systems (MEMS) Devices IV. Symposium (Materials Research Society Symposium Proceedings vol. 687), 2002, pp. B5.16.1-B5.16.6.
Ilyas, S., et al., "An Experimental and Theoretical Investigation of a Micro Mirror Under Mixed-Frequency Excitation," Journal of Microelectromechanical Systems, 2015.
International Search Report in related International Application No. PCT/IB2016/051986, dated Jun. 24, 2016.
Je, S-S, et al., "A Compact, Low-Power, and Electromagnetically Actuated Microspeaker for Hearing Aids," IEEE Electron Device Letters, Aug. 2008, vol. 29, No. 8, pp. 856-858.
Kim, H.J., et al., "A Piezoelectric Microspeaker with a High-Quality PMN-PT Single-Crystal Membrane," Journal of the Korean Physical Society, Feb. 2009, vol. 54, No. 2, pp. 930-933.
Kim, H.J., et al., "High Performance Piezoelectric Microspeakers and Thin Speaker Array System," ETRI Journal, Dec. 2009, vol. 31, No. 6, pp. 680-687.
Kontomicho, F., et al., "Alternative Encoding Techniques for Digital Loudspeaker Arrays," presented at the Audio Engineering Society Convention 122, May 1, 2007.
Marnat, L., et al., "New Movable Plate for Efficient Millimeter Wave Vertical on-Chip Antenna," IEEE Transactions on Antennas and Propagation, Apr. 2013, vol. 61, No. 4, pp. 1608-1615.
Tatlas, N-A, et al., "Digital Loudspeaker Arrays Driven by 1-bit Signals," Audio Engineering Society 116th Convention, May 2004.
Valousek , P., "A Digital Loudspeaker: Experimental Construction," Acta Polytechnica, 2006, vol. 46, No. 4.
Written Opinion of the International Searching Authority in related International Application No. PCT/IB2016/051986, dated Jun. 24, 2016.
Arevalo; "A versatile multi-user polyimide surface micromachinning process for MEMS applications"; downloaded on Intnernet [file:///C:/Users/deborah/Downloads/Aversatilemulti-userpolyimide surfacemicromachinningprocessforMEMSapplications%20(1).pdf] on Sep. 16, 2019; 6 pages.
Conchuso-Gonzalez; "Out-of-plane platforms with bi-directional thermal bimorph actuation for transducer applications"; downloaded from internet [file:///C:/Users/deborah/Downloads/Out-of-planePlafformswithBi-directionalThermalBimorphActuationforTransducerApplications%20(2).pdf] on Sep. 16, 2019; 6 pages.

* cited by examiner

MEASRUMENTS OF THE NATURAL MODES OF RESONANCE

| Mode | Natural Frequency | Composing Modes |
|---|---|---|
| 1 | 71.094 kHz | 0 - diameter node, 1 - circular node |
| 2 | 106.938 kHz | 1 - diameter node, 1 - circular node |
| 3 | 110.200 kHz | 1 - diameter node, 1 - circular node |
| 4 | 145.359 kHz | 2 - diameter node, 1 - circular node |
| 5 | 147.406 kHz | 0 - diameter node, 2 - circular node |
| 6 | 161.375kHz | 3 - diameter node, 1 - circular node |

Table 1: Materials Properties

| Property | Polyimide | Gold |
|---|---|---|
| Relative permittivity ($\varepsilon_r$) | 2.9 | 6.9 |
| Young's modulus (E) | $3.1e^9$ $[Pa]$ | $70e^9$ $[Pa]$ |
| Poisson's ratio (v) | 0.34 | 0.44 |
| Density (ρ) | 1300 $[kg/m^3]$ | 19300$[kg/m^3]$ |

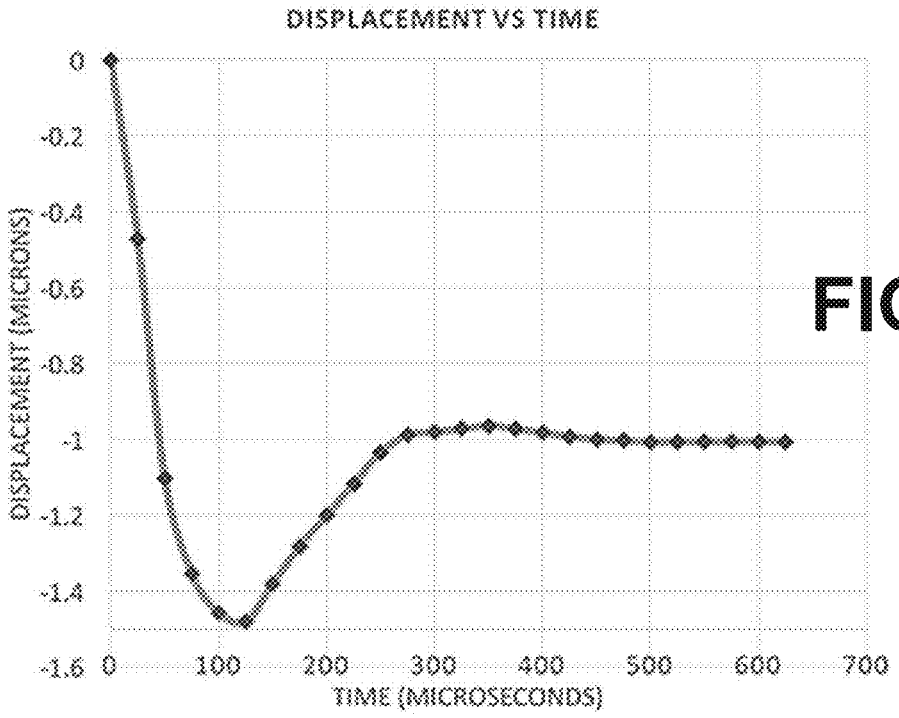

FIG. 19E

SET OF MASKS USED FOR FABRICATION.

| Mask Name | Remarks |
|---|---|
| [METAL_0] | Layout for contact pads and device labeling. |
| [ANCHOR] | Features used to fix the semi free-standing structures. |
| [DIMPLE] | Structural features to prevent device stiction. |
| [METAL_1] | First metallization layer. |
| [METAL_2] | Second metallization layer. |
| [M1_M2_VIA] | Via-holes for connection of M1 and M2. |
| [STRUCTURAL] | Polyimide structural layer. |

FIG. 20A

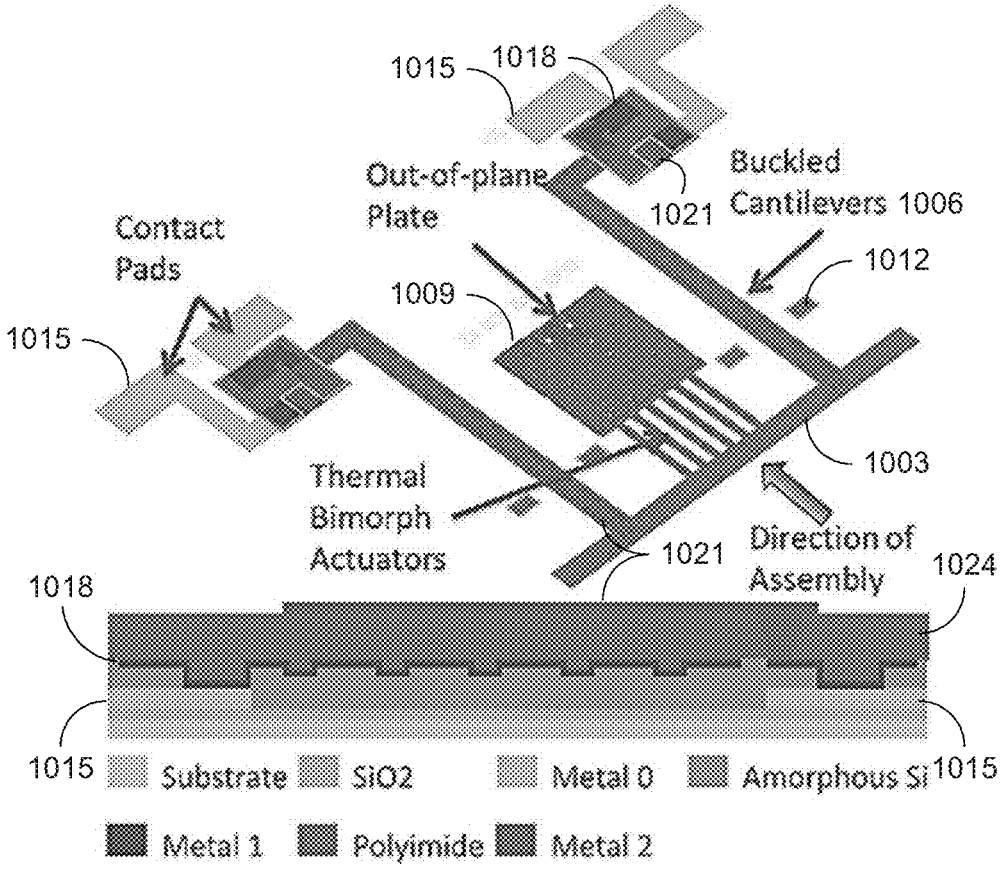
FIG. 23A
FIG. 23B
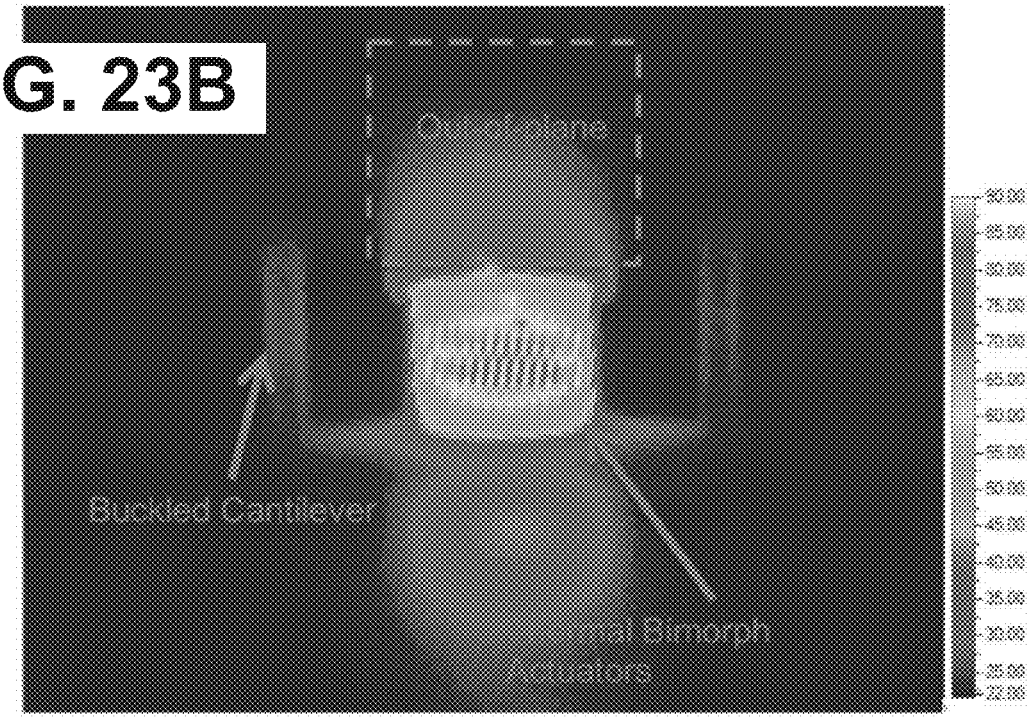

PIEZOELECTRIC ARRAY ELEMENTS FOR SOUND RECONSTRUCTION WITH A DIGITAL INPUT

CROSS REFERENCE TO RELATED APPLICATIONS

This application is a Divisional of U.S. application Ser. No. 15/563,829, filed Oct. 2, 2017, which is a 371 National Stage of International Application No. PCT/IB2016/051986, filed on Apr. 7, 2016, which claims priority and benefit from U.S. Provisional Application entitled "PIEZOELECTRIC ARRAY ELEMENTS FOR SOUND RECONSTRUCTION WITH A DIGITAL INPUT" having Ser. No. 62/144,502, filed Apr. 8, 2015, which are hereby incorporated by reference in their entirety.

BACKGROUND

The consumer electronics industry constantly evolves with changes in market demand and the desire to provide higher quality products. Improvements including smaller dimensions, low power consumption and better quality of components such as speakers, microphones, humidity sensors, accelerometers, gyroscopes, and cameras are in high demand. In the area of digital audio technology, the elimination of components that introduce noise when digital signals are converted to analog signals, which are normally reproduced by commercial speaker drivers, can provide improved performance.

SUMMARY

Embodiments of the present disclosure are related to sound reconstruction with a digital input using, e.g., piezoelectric array elements.

In one embodiment, among others, a digital loudspeaker comprises a fixed frame and an array of transducers disposed on the fixed frame. Individual transducers of the array of transducers can comprise a flexible membrane disposed on a piezoelectric actuation element positioned over a corresponding opening that extends through the fixed frame. In another embodiment, a method comprises forming a flexible membrane structure on a substrate and backetching the substrate opposite the flexible membrane structure. The flexible membrane structure can be formed by disposing a first electrode layer on a substrate, disposing a piezoelectric layer on the first electrode layer and disposing a second electrode layer on the piezoelectric layer. A flexible membrane layer can be disposed on the second electrode layer.

In one or more aspects of these embodiments, the piezoelectric actuation element can comprise a layer of piezoelectric material and a plurality of electrodes in contact with the layer of piezoelectric material. The plurality of electrodes can comprise parallel electrodes disposed on opposite sides of the layer of piezoelectric material. The plurality of electrodes can comprise interdigitated electrodes disposed on one side of the layer of piezoelectric material. The piezoelectric material can be lead-zirconate-titanate (PZT). The electrodes can comprise platinum. Polarization of the layer of piezoelectric material via the plurality of electrodes can distort the flexible membrane with respect to the fixed frame. The flexible membrane can be formed of polyimide.

In one or more aspects of these embodiments, the array of transducers can be configured to provide at least 3-bit resolution of an audio signal. 3-bit resolution can be provided by seven transducers. A diameter of an outer edge of the piezoelectric actuation element can be less than a diameter of an inner surface of the corresponding opening. The piezoelectric actuation element can comprise a plurality of connection lines extending outward from the outer edge. The plurality of connection lines can extend radially outward beyond the diameter of the inner surface of the corresponding opening. The fixed frame can be a plate of a buckled cantilever platform. The buckled cantilever platform can comprise bimorph actuators configured to adjust position of the plate in response to thermal heating.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims. In addition, all optional and preferred features and modifications of the described embodiments are usable in all aspects of the disclosure taught herein. Furthermore, the individual features of the dependent claims, as well as all optional and preferred features and modifications of the described embodiments are combinable and interchangeable with one another.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIGS. 19A through 19E illustrate simulation results of a fabricated hexagonal membrane in accordance with various embodiments of the present disclosure.

FIGS. 20A and 20B illustrate an example of a micromachining fabrication process for MEMS applications in accordance with various embodiments of the present disclosure.

FIGS. 23A and 23B illustrate an example of the construction and heating of a BCP with bimorph actuators in accordance with various embodiments of the present disclosure.

DETAILED DESCRIPTION

Figure 1:
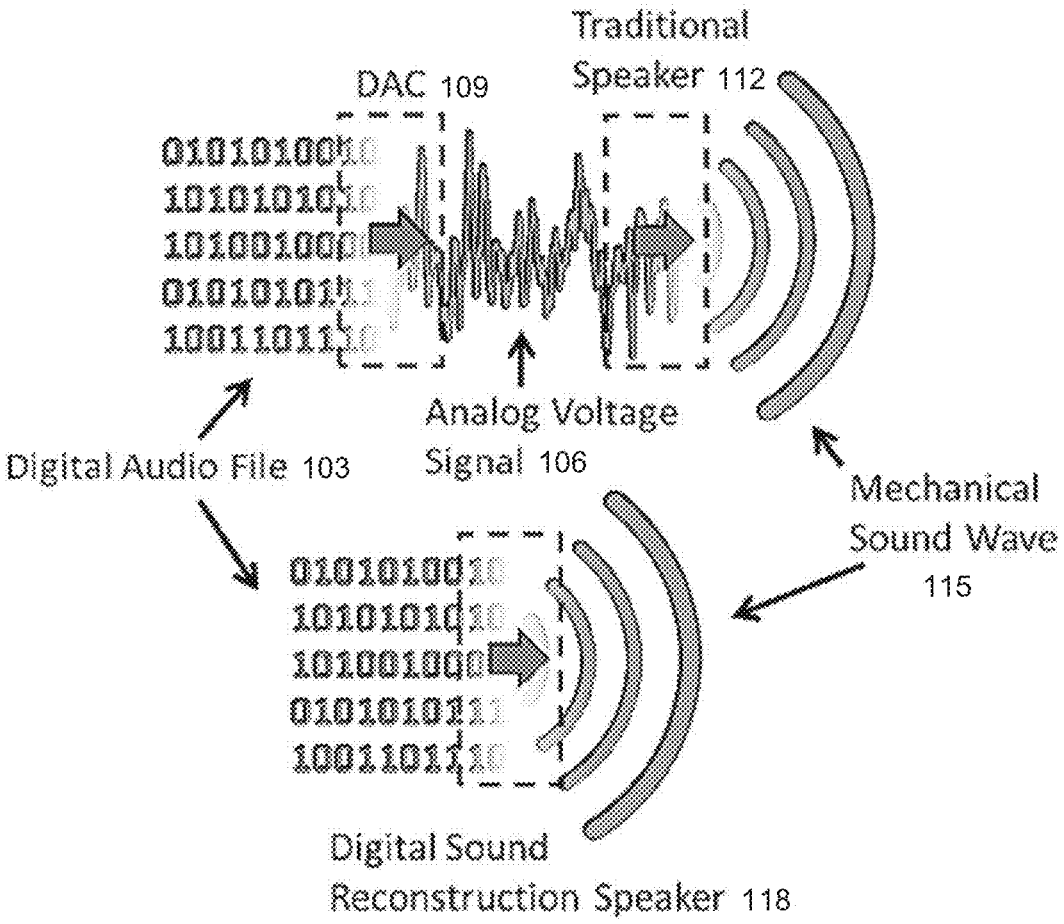
FIG. 1 is a graphical representation illustrating examples of traditional and digital transducer array sound reproduction cycles in accordance with various embodiments of the present disclosure.

Disclosed herein are various examples related to piezoelectric array elements for digital sound reconstruction. The fabrication, characterization and operation of a single piezoelectric actuator for digital sound reconstruction will be discussed. A system utilizing the piezoelectric actuator can facilitate the direct communication of a digital audio signal to an acoustic transducer without the need of a digital-to-analog converter (DAC). Reference will now be made in detail to the description of the embodiments as illustrated in the drawings, wherein like reference numbers indicate like parts throughout the several views.

The concept known as "Digital Sound Reconstruction" uses a digital transducer array loudspeaker (DTAL) to reproduce binary pulses that can be added together to reconstruct an analog audio signal. Existing problems associated with conventional analog speakers (e.g., frequency response and linearity) could be diminished by the DTAL. Referring to FIG. 1, shown is a graphical representation illustrating traditional and DTAL sound reproduction cycles. In a conventional configuration, information in the digital audio file 103 is converted to an analog voltage signal 106 by a DAC 109 and used to drive a traditional speaker 112 to produce the mechanical sound wave 115. In a DTAL configuration, the information in the digital audio file 103 is directly converted by a digital sound reconstruction speaker 118 (e.g., a DTAL) to produce the mechanical sound wave 115. The space and power demand of the DAC 109 can be eliminated from a chip by using the DTAL configuration. A true digital micro-loudspeaker (μLoudspeaker) can be implemented with an array of acoustic actuators. These actuators (or transducers) comprise a flexible membrane fabricated using, e.g., polyimide, which can be actuated using a lead-zirconate-titanate (PZT) piezoelectric ceramic layer.

This transducer array can be organized by sets of transducers that are associated with the number of bits used to reconstruct the analog signal in a digital μLoudspeaker. Therefore, this configuration is referred as a "binary weighted group". For example, a 3-bit speaker will have three sets of transducer actuators. The first set comprises 4 transducer actuators that represent the most significant bit (MSB). The second set of transducers includes two actuators for the second most significant bit and the third set is just a single transducer that accounts for the least significant bit (LSB). In a DTAL the weight of each implemented configuration is given by the number of transducers in each bit group (e.g., 1, 2, 4, 8, . . . $2^n$). In this disclosure, the mechanical and electrical response of a single acoustic transducer array is characterized and a fabrication process that enables the realization of DTAL devices is presented.

Digital Sound Reconstruction Concept

Figure 2A:
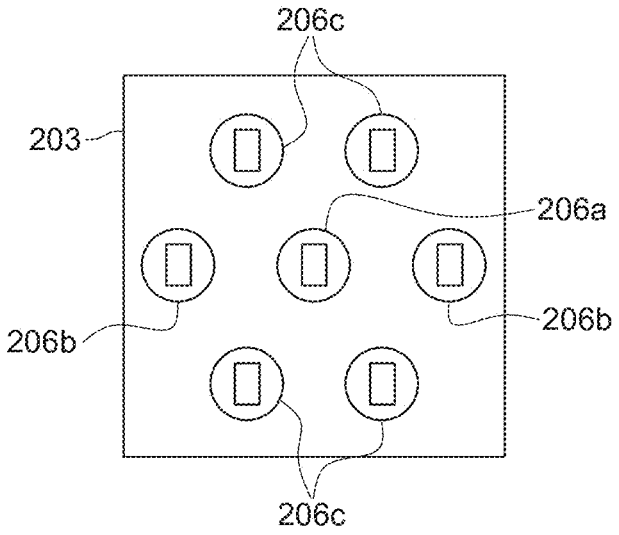
FIGS. 2A and 2B illustrate an example of a digital transducer array loudspeaker (DTAL) and sound reconstruction using the DTAL, respectively, in accordance with various embodiments of the present disclosure.
Figure 2B:
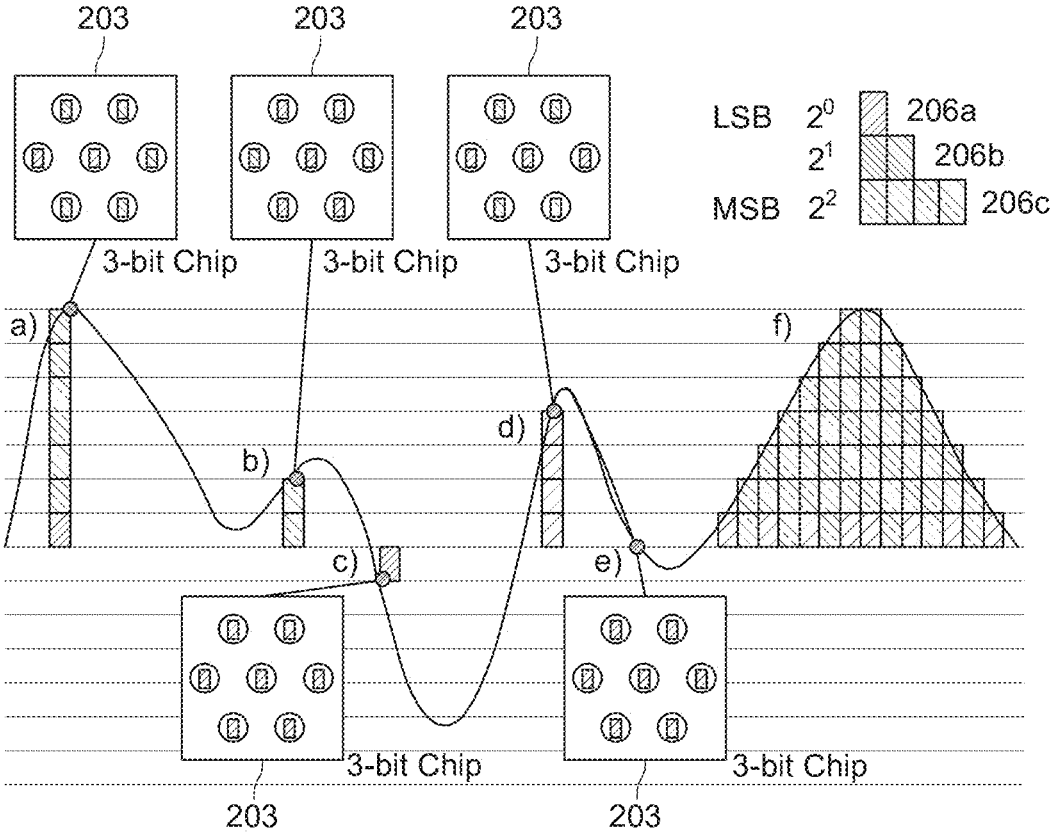

Sound reconstruction, using a DTAL device, is produced by the addition of the small sound contributions that are created by the activation of one or more individual transducers at any discrete period of time. An example of this concept applied in a 3-bit loudspeaker is depicted in FIGS. 2A and 2B. As shown in FIG. 2A, the DTAL device 203 comprises seven acoustic transducers 206 that are activated digitally and whose individual contributions make up for pressure changes needed to represent an analog audio signal. The analog signal at point (a) of FIG. 2B can be reconstructed by the actuation of all seven transducers 206*a*, 206*b* and 206*c* in the 3-bit chip. The response of each individual transducer 206 is added together in order to reproduce the equivalent sound of the analog wave. At point (b) of FIG. 2B, only two transducers 206*b* are needed to achieve the same amplitude as the analog wave. An example of a negative sound pressure is shown at point (c), where only the transducer 206*a* of the LSB is actuated but in the opposite direction to reconstruct the original signal. At position (d) of FIG. 2B, the four transducers 206*c* of the MSB are actuated simultaneously. Likewise, the initial or idle position of the transducers 206*a*, 206*b* and 206*c* is represented at point (e), where the system moves from positive pressure to negative pressure, or vice versa.

The operation of the DTAL device 203 is such that when lower pressure is needed, fewer actuators can be activated and when higher pressure is needed, more actuators can be used. A complete digital reconstruction of a section of the analog sound wave is shown at (f) in FIG. 2B. Different combinations of the actuated transducers 206 are used to match the analog waveform at each digital point along that section of the sound wave. As can be seen in FIG. 2B, each actuator displacement contributes to a small pressure change in the system, which is a portion of the total sound pressure change generated by the DTAL device 203.

The response of each individual transducer 206 depends on the digital clock that synchronizes the reconstruction process. This makes the actuation of the transducers 206 independent of the audio frequency being reconstructed, and therefore enables similar sound reconstruction at high and low analog frequencies. This means that the individual transducers 206 are not tied to a specific operational frequency range, as compared to the common design rules of loudspeakers. The acoustic actuators 206 respond to the sampling frequency of the sound reconstruction process (e.g., greater than or equal to 44.1 kHz).

Design Development

"Digital sound reconstruction using arrays of CMOS-MEMS microspeakers" by Diamond et al. (TRANSDUCERS, 12th International Conference on Solid-State Sensors, Actuators and Microsystems, vol. 1, pp. 238-241, 2003), which is hereby incorporated by reference in its entirety, reported a direct digital method of sound reconstruction using CMOS-MEMS arrays as micro-speakers in a singles chip. Their initial proof of concept was fabricated using seven large individual transducers that were wire bonded to create a 3-bit array. These transducers were fabricated separately as individual chips and later put together to produce the final device. A set of CMOS-MEMS arrays was proposed as micro-speakers in a single chip. Each transducer in the array comprises a fixed bottom electrode and a suspended moving-membrane with a second electrode. When voltage is applied between the membrane's electrode and the substrate's electrode, the membrane buckles down and comes into contact with the substrate. When the voltage is removed, the membrane buckles up and springs back to its idle position. The negative pressure change was shorter than the positive pressure change since the bottom electrode stops the membrane's downward displacement. When the membrane is released to generate a positive pressure pulse, the upward displacement of the membrane overshoots and becomes larger than the negative displacement. In this case, the membrane is free to move by design, and the only limitation comes from the spring constant force. In addition, the membrane has a frequency response in the positive direction in which the system continues to oscillate until the vibration decreases by means of air damping. For this reason, negative and positive actuation showed an asymmetry in their system. The electrostatic principle was used as the driving mechanism of the devices, but this was not sufficient to compete with modern loudspeakers due to the asymmetry.

Embodiments of the current disclosure use the piezoelectric effect as the actuation mechanism for the acoustic transducer, rather than the electrostatic actuation used by Diamond et al. Piezoelectric actuation can reduce the power consumption of the DTAL device 203 (FIG. 2) and remove asymmetric motion of the membranes. A symmetric motion, by means of piezoelectricity, can eliminate the undesirable noise of the acoustic device. Piezoelectric actuators can be used as transducers 206 (FIG. 2) in the form of cantilevers or membranes, which can generate a displacement by applying an electric field to the piezoelectric layer (inverse piezoelectric effect) or a voltage by applying a force to the structure (direct piezoelectric effect).

Figure 3A:
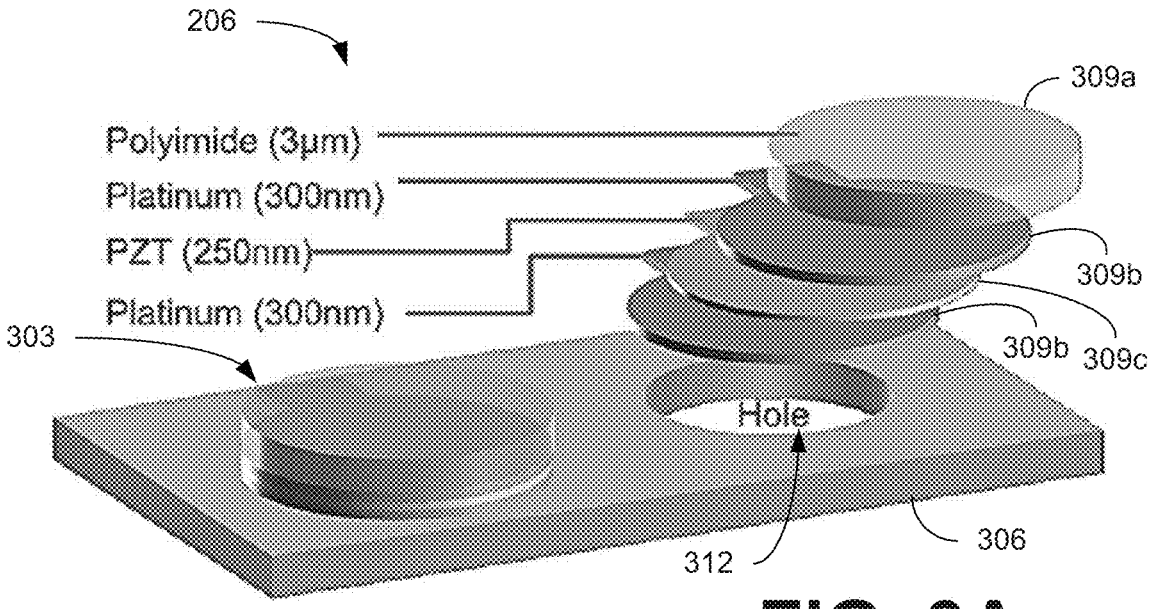
FIGS. 3A through 3E illustrate examples of piezoelectric transducer structures and their operation in accordance with various embodiments of the present disclosure.

Referring to FIG. 3A, shown is an example of piezoelectric micro-speaker components, which include a piezoelectric actuator diaphragm or membrane structure 303 and a fixed frame (or substrate) 306. The example of FIG. 3A includes a circular membrane structure 303 with a diameter of about 1 mm and a thickness of about 4 μm. The membrane structure 303 can be processed on silicon and is fixed at its edge to the substrate 306. In the example of FIG. 3A, the membrane structure 303 includes four physical layers 309, which is fixed over an opening (or hole) 312 extending through a silicon substrate 306. The layers 309 include a flexible membrane 309*a* (e.g., a layer of polyimide or other appropriate flexible material) and electrodes 309*b* on either side of a piezoelectric material 309*c* (e.g., layers of platinum and/or chromium on either side of a layer of lead-zirconate-titanate (PZT)).

Figure 3B:
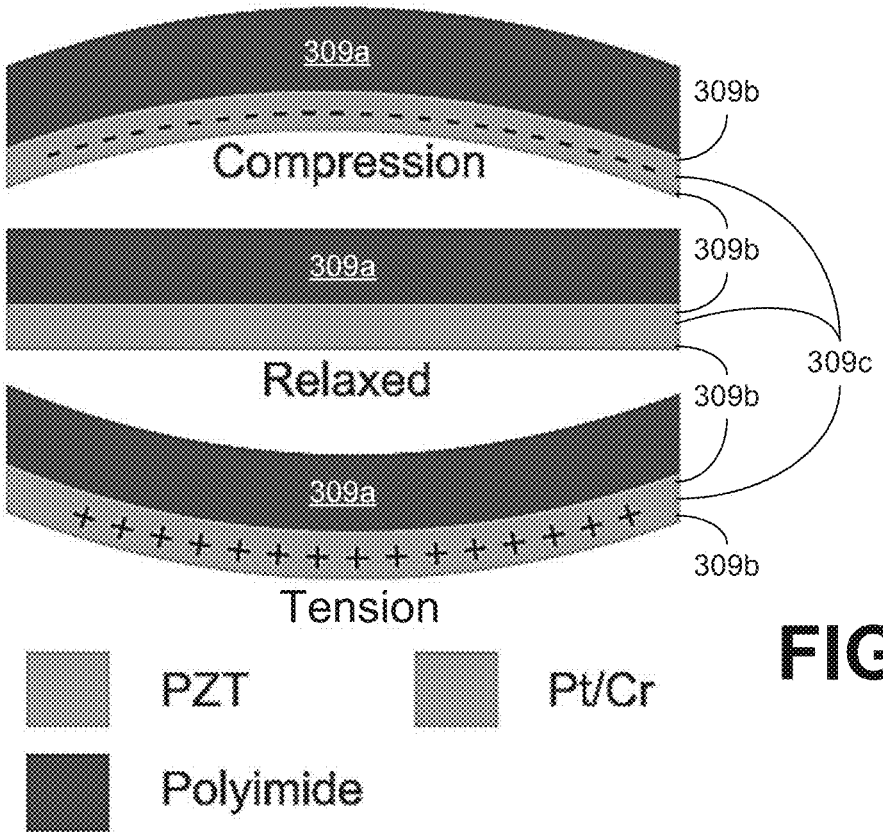
Figure 3C:
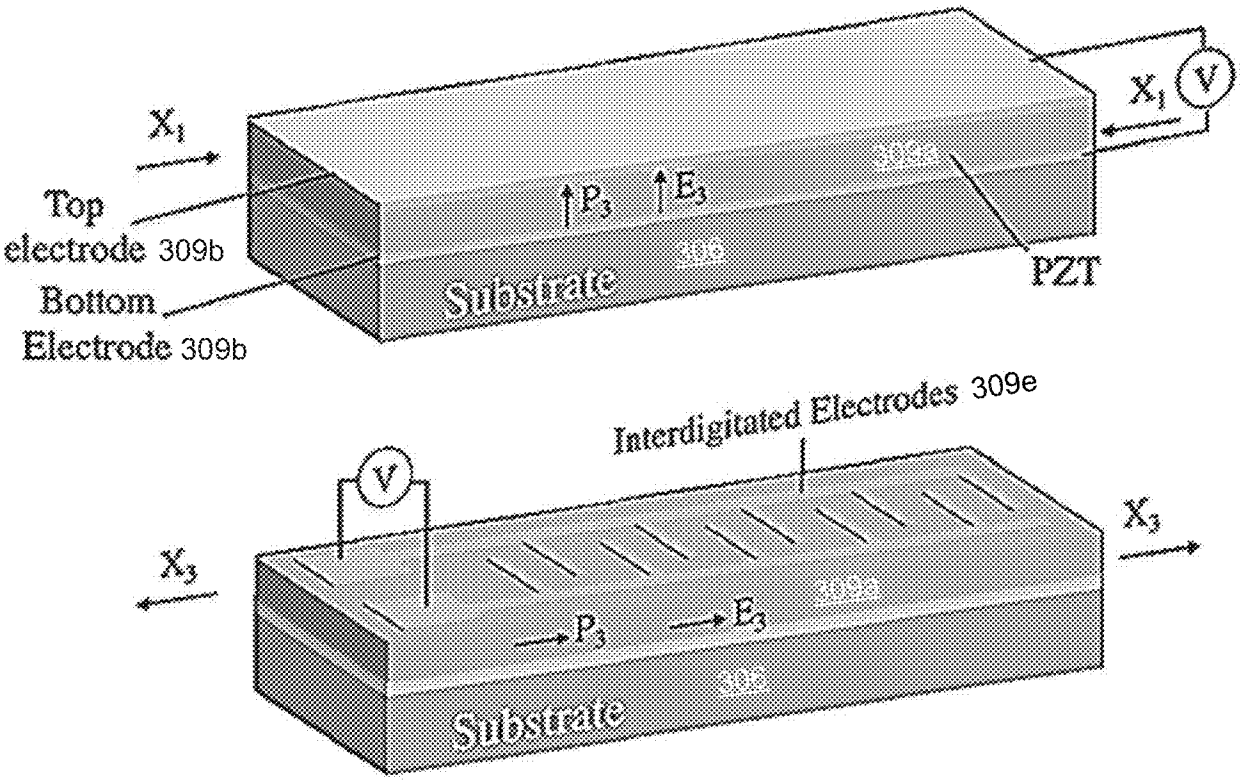
Figure 3D:
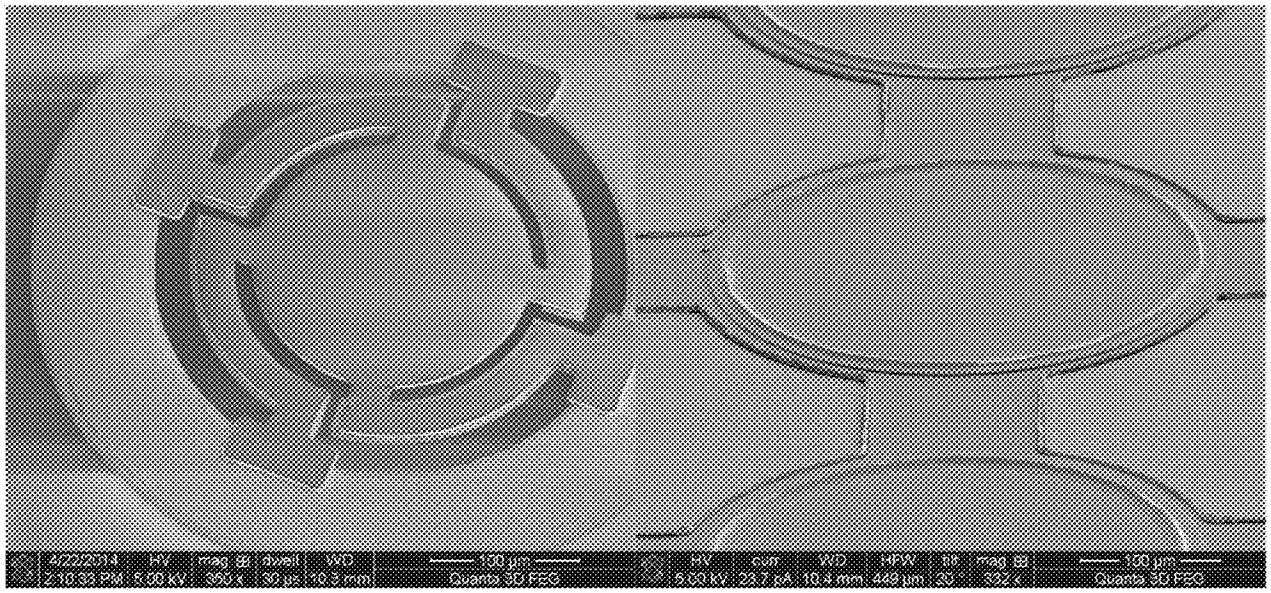
Figure 3E:
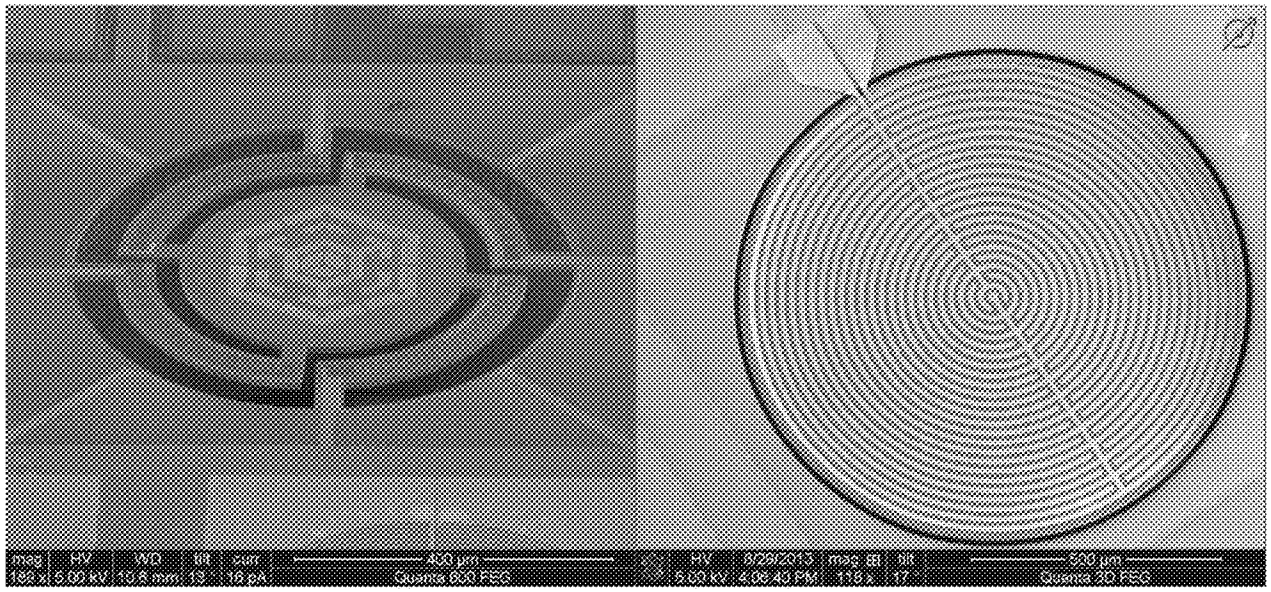

Typically, piezoelectric devices are designed to operate in two modes: a D31 mode and a D33 mode. In the D31 mode of operation, an electric field is applied normal to the piezoelectric film 309*c* via parallel electrodes 309*b* and produces a compression in-plane strain. In the D33 mode, an in-plane electric field via interdigitated electrodes 309*b* is used to produce a tension in-plane strain. If the polarization is reversed, the behavior of the piezoelectric material 309*c* generates strain in the opposite direction. In this example, the D31 mode was chosen for verification because it could be fabricated using a simpler process and design. The actuation principle for the piezoelectric actuators (or transducers) 206 (FIGS. 2A and 2B) is illustrated in FIG. 3B. Because the piezoelectric film 309*c* is placed underneath the polyimide layer 309*a*, a tension stress due to positive polarization bends the actuator structure downwards. Whereas a negative polarization produces a compression stress that bends the actuator structure upwards. FIG. 3C illustrates the difference between devices including parallel electrodes 309*b* located on the top and bottom surfaces of the piezoelectric film 309*c* (top representation) and interdigitated electrodes 309*e* located on one surface of the piezoelectric film 309*c* (bottom representation). FIGS. 3D and 3E show images of D31 mode implementations and D33 mode implementations, respectively. While the D31 mode implementations are easier to fabricate, the D33 mode implementations offer greater potential because of the larger displacement distances.

Description of a Fabrication Process

Figure 4:
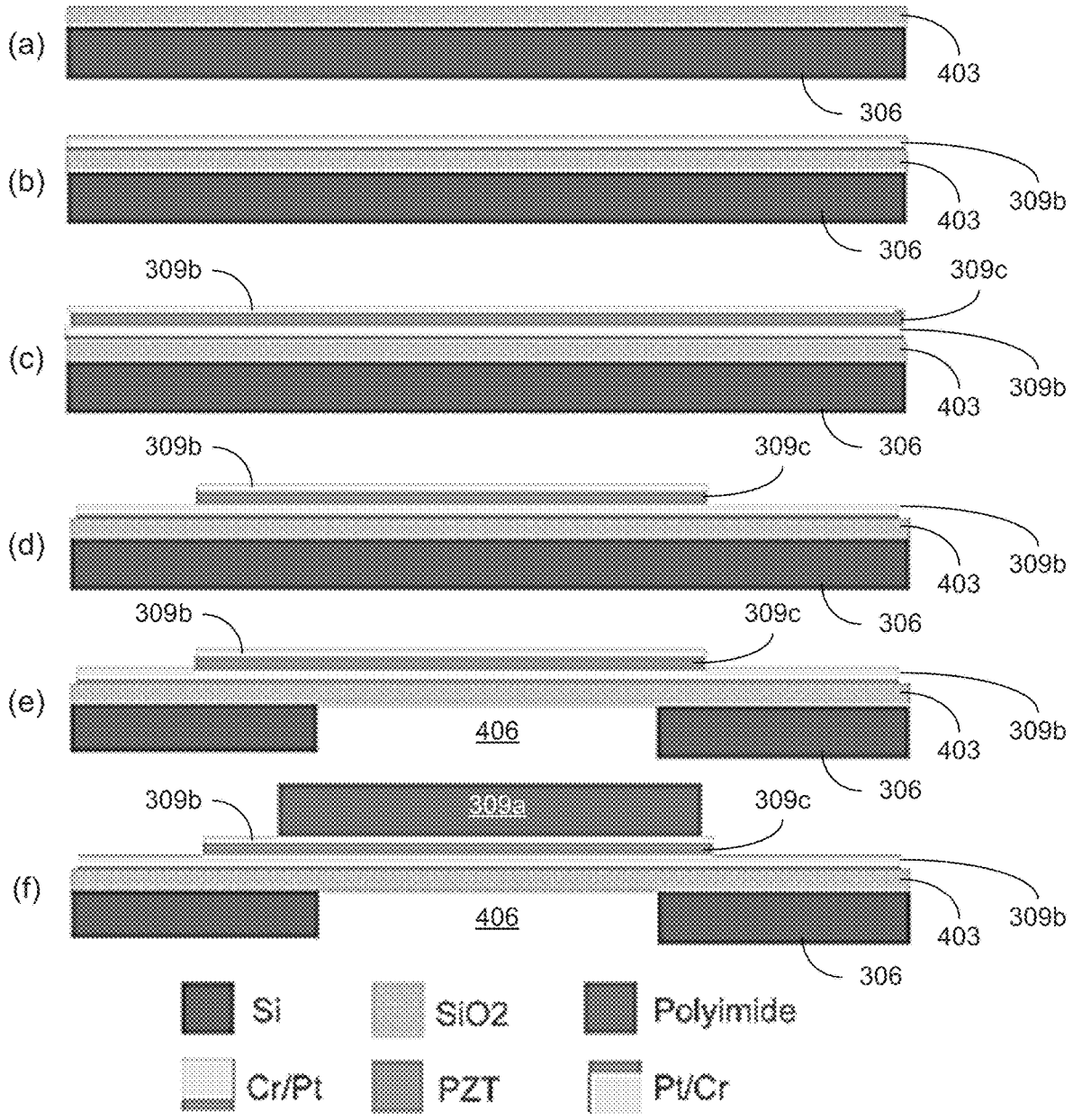
FIG. 4 shows an example of a fabrication process for the piezoelectric transducer structure of FIGS. 3A and 3B in accordance with various embodiments of the present disclosure.

Referring now to FIG. 4, shown is an example of the fabrication of a digital transducer array of a DTAL device 203 (FIG. 2). Beginning with view (a), acoustic membrane structures (or transducers) 206 (FIG. 2) were fabricated on a 500 nm thick substrate 403 of thermally grown silicon oxide ($SiO_2$) on the fixed frame 306, which was used as a diffusion barrier and as an etch-stop in the last step of the fabrication process. Then a common ground layer 309*b* of platinum (Pt) was deposited on the $SiO_2$ substrate 403 with a nominal thickness of 300 nm as illustrated in view (b). This layer was used as the bottom electrode 309*b* and also helped the PZT crystal 309*c* to grow with the desired crystal structure.

After this, as shown in view (c), a sol-gel PZT layer 309*c* was spun (from Mitsubishi) to a nominal thickness of 250 nm. This deposition was achieved through three cycles of coating and thermal annealing at 650° C. Following the annealing step, a lift-off process was used to pattern the top electrode 309*b* using a platinum (Pt) layer of about 300 nm as illustrated in view (d). A hard mask of titanium nitride (TiN) was then used to etch the PZT layer 309*c*. As shown in view (e), an opening can be etched through the fixed frame 306 to allow for symmetric motion of the membrane. The bottom of the wafer can be backetched using deep reactive ion etching (DRIE) to release the membrane.

The final piezoelectric layer 309*c* has a nominal thickness of approximately 250 nm. As shown in view (f), the flexible membrane layer 309*a* of polyimide was then processed after the pyrolisys steps, due to the polyimide's decomposition temperature of 450° F. This material can be processed following the procedure described in "Out-of-plane Platforms with Bi-directional Thermal Bimorph Actuation for Transducer Applications" by Conchouso et al. and/or "A Versatile Multi-User Polyimide Surface Micromachining Process for MEMS Applications" by Arevalo et al., both of which are hereby incorporated by reference in their entirety. Other materials such as, e.g., SU-8 can be potentially used to have desired results. In some implementations, the bottom of the wafer can be backetched using deep reactive ion etching (DRIE) to release the membrane after the application of the flexible membrane layer 309*a*. The wafer can then be diced into chips using, e.g., an automatic dicer saw system or an automatic scriber.

EXPERIMENTAL RESULTS AND MEMBRANE CHARACTERIZATION

Figure 5:
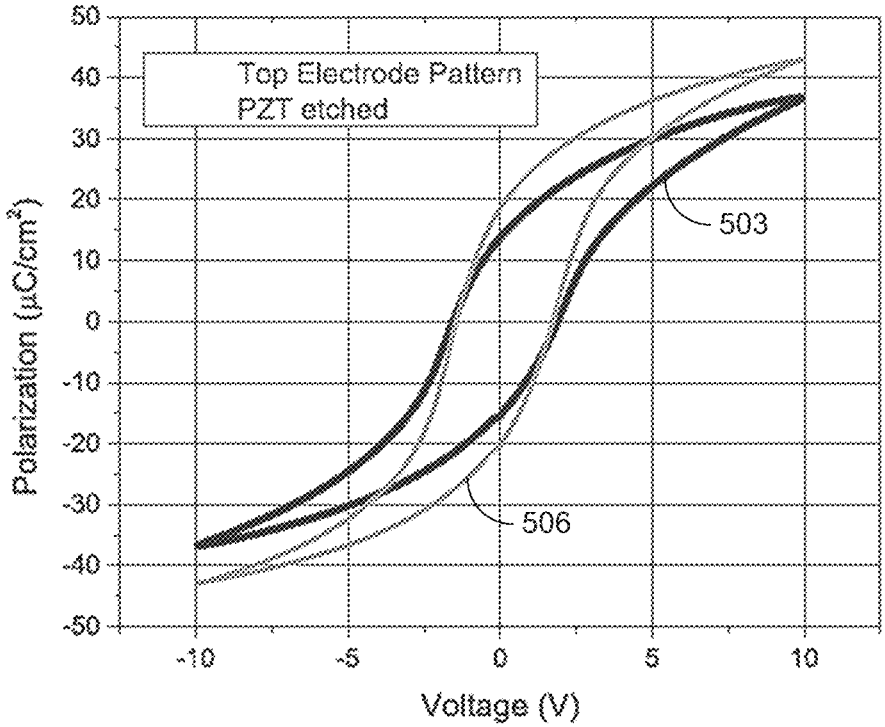
FIG. 5 is a plot of measured hysteresis curves of a fabricated piezoelectric membrane in accordance with various embodiments of the present disclosure.

A polarization step is commonly used before testing or using piezoelectric devices, but there was no need to polarize the piezoelectric layer 309*c* due to the self-polarization of PZT thin films with a thickness below 400 nm. The self-polarization effect was characterized using a TF-Analyzer 2000 to measure the hysteresis loop after patterning of the top electrode 309*b* and after patterning of the PZT layer 309*c* as shown in FIG. 5. The hysteresis curve 503 of the fabricated piezoelectric membrane 309*c* was measured before the release steps and it was used as reference point to evaluate if the posterior etch processes had any effect on the behavior of the PZT polarization. The maximum polarization achieved at 10 V, before the PZT was etched is $P_{max}$=36.68 μC/cm$^2$. After the PZT layer 309*c* and polyimide layer 309*a* were patterned using RIE, the polarization was measured again (curve 506), showing a maximum polarization in the piezoelectric film 309*c* of $P_{max}$=42.89 μC/cm$^2$. In both plots, the polarization achieved well saturated and symmetrical P-V curves. As can be seen in FIG. 5, there was an improvement after the etch of the PZT layer 309*c*, which is a good characteristic for the membrane structure in comparison to other reported PZT speakers.

Figure 6A:
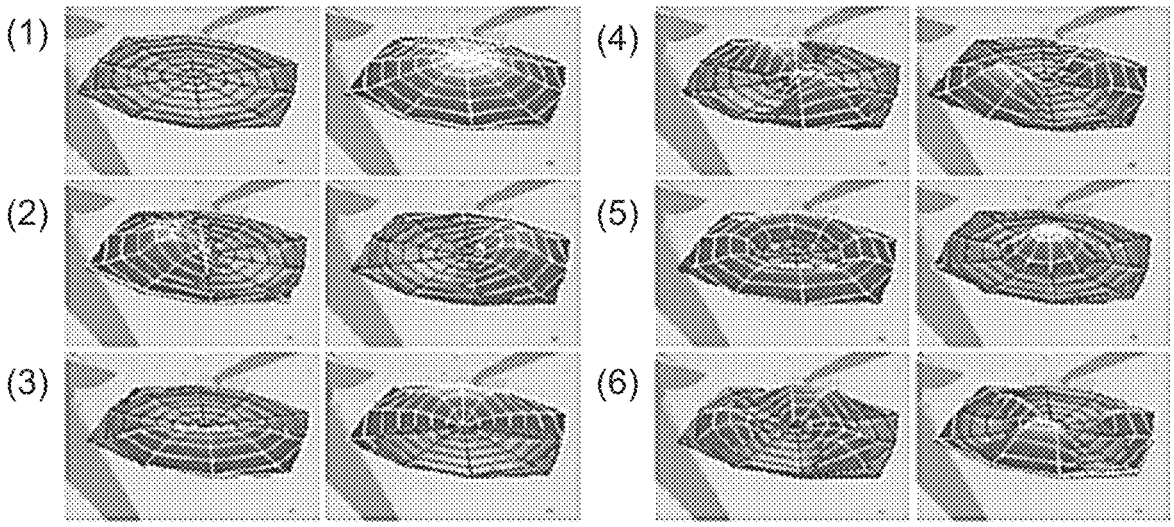
FIGS. 6A and 6B illustrate the first six resonance modes of a fabricated circular piezoelectric membrane in accordance with various embodiments of the present disclosure.
Figures 6B, 7A:
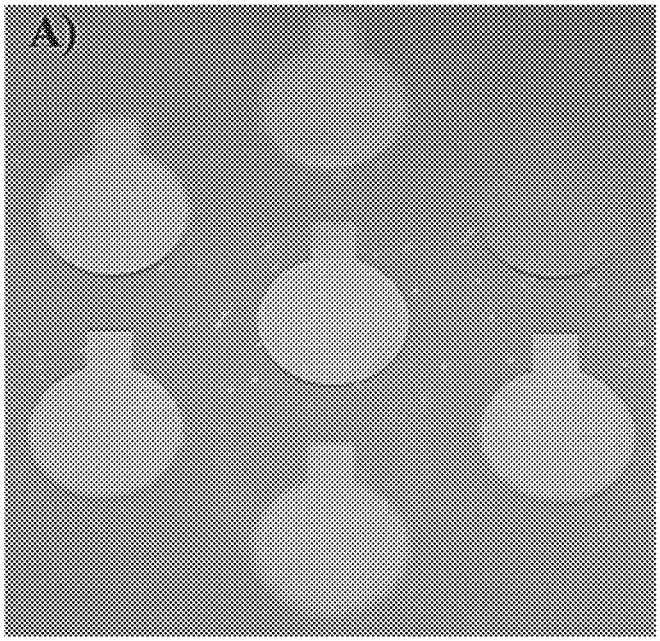
FIG. 7A is an image of a 3-bit array of piezoelectric membrane structures (or actuators) before piezoelectric patterning in accordance with various embodiments of the present disclosure.

The fabricated polyimide/PZT/$SiO_2$ membranes were further characterized mechanically using a Polytec laser Doppler vibrometer and white light interferometry system. With these tools, the membranes were operated with voltages ranging from 10-25 V and extract their natural frequency modes. FIG. 6A shows the first six resonance modes of the fabricated circular membrane that were measured with the laser Doppler vibrometer. The membrane devices where stimulated with a white noise signal and a scan was performed to find the structures resonance frequency modes. The table of FIG. 6B summarizes these measurements. The first resonance mode was found at around 71 kHz, allowing these actuators to digitally reconstruct the audio signal at a frequency of at least 3 fold the maximum acoustic frequency of 20 kHz. The natural modes of resonance of the stacked membrane are well above a sampling frequency of 44.1 kHz.

Figure 7B:
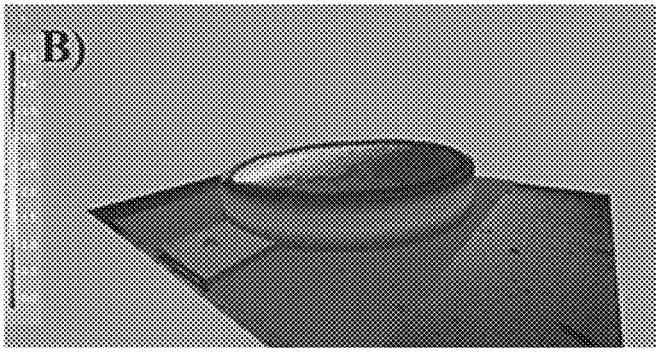
FIGS. 7B, 7C and 8 show measurement and simulation results of a fabricated circular piezoelectric membrane in accordance with various embodiments of the present disclosure.
Figure 7C:
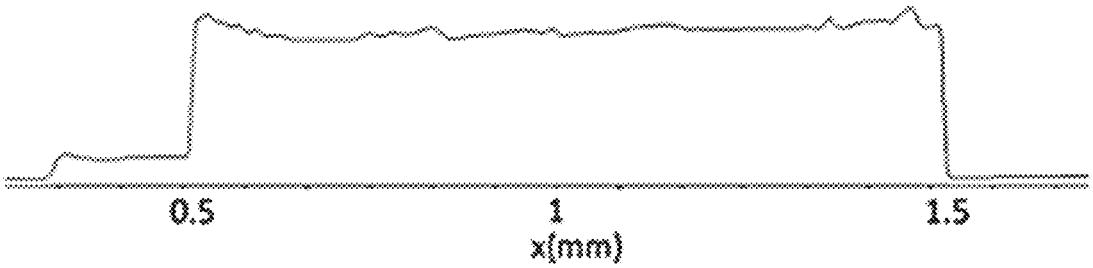

Referring next to FIG. 7A, shown is an optical photograph of the wafer including an array of transducers before PZT patterning, hence the pinkish color of the background. The photograph of FIG. 7A shows a 3-bit array of membrane structures (or actuators) 206 as shown in FIG. 2A. The membranes have not been connected. FIG. 7B shows the topology measurement using the white light interferometry capability of the same Polytec tool and FIG. 7C shows a cross-sectional plot of the topology measurement of FIG. 7B. Finally, the fabricated individual membranes were subjected to a sweep voltage from 1 kHz to 10 kHz using a sinusoidal wave of 25 V. These actuators (or transducers) 206 (FIG. 2A) were able to reproduce the sweeping sound at a low intensity, showing promising results for the development of a truly digital μLoudspeaker with symmetrical displacement.

Figure 8:
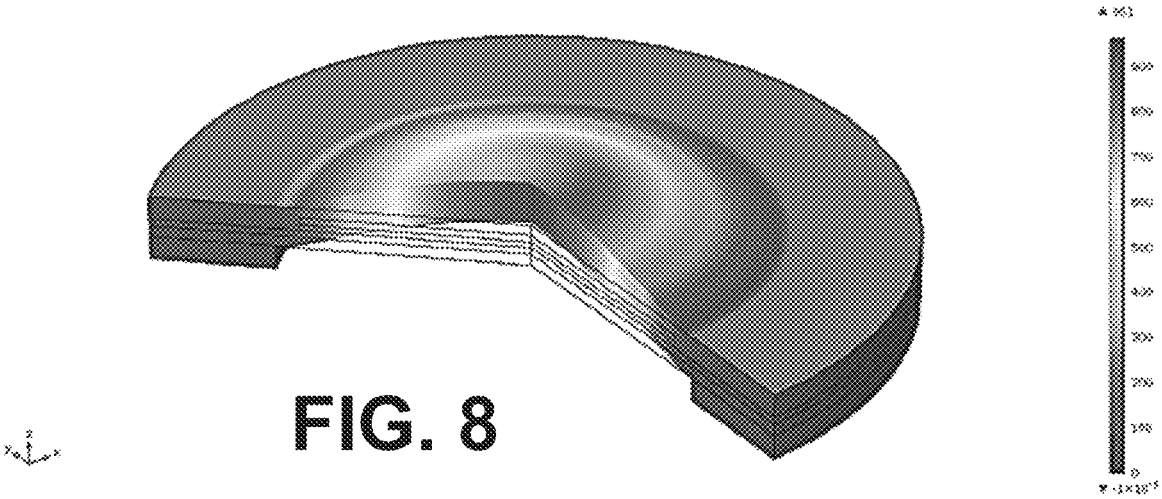
Figure 9A:
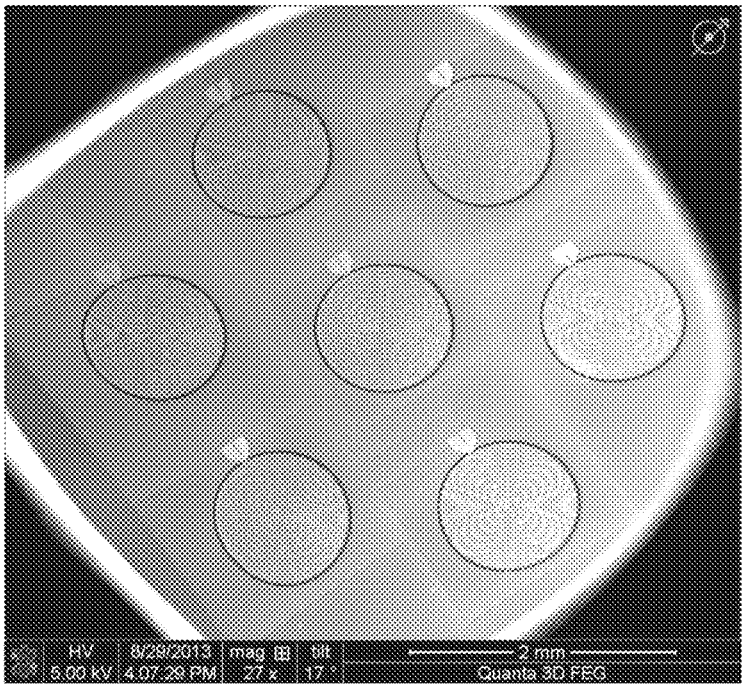
FIGS. 9A and 9B are images of examples of arrays of piezoelectric membrane transducers for digital sound reconstruction in accordance with various embodiments of the present disclosure.
Figure 9B:
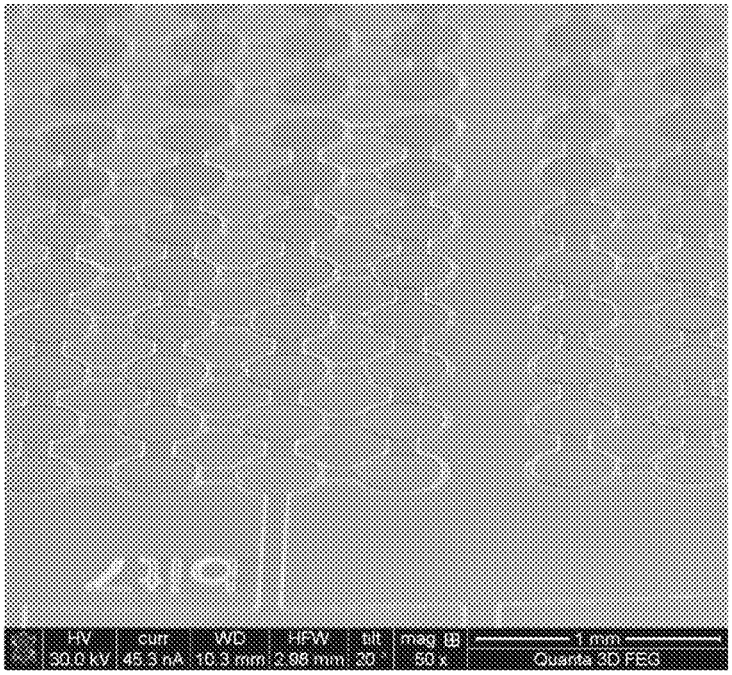

Finite Element Modeling (FEM) using COMSOL Multiphysics has also been carried out to evaluate the motion of the membrane. FIG. 8 illustrates an example of an actuated membrane solved using COMSOL. The simulation shows a 1 mm membrane with a PZT actuation film of 900 nm in diameter. FIG. 8 shows that the displacement of the membrane is up to 961 μm, at the center of the wafer. FIGS. 9A and 9B are images of true digital μLoudspeaker arrays for digital sound reconstruction with 3-bit or higher resolution (e.g., 8-bit).

The piezoelectric device presented in this disclosure was able to achieve a competitive performance on the piezoelectric properties of the thin film when compared to previous research. The natural resonant frequency modes of the piezoelectric actuator determined and show that it is feasible to reconstruct any audio frequency by means of digital sound reconstruction. The dimensions of the membrane are of about 1 mm in diameter and about 4 μm in thickness, and is capable of being symmetrically actuated in both upward and downward directions due to the back etch step releasing the membrane. The electrical characterization showed an improvement in the polarization of the piezoelectric material after its final etch patterning step, and the mechanical characterization shows the natural modes of resonance of the stacked membrane.

The optimization and fabrication of these actuators and their acoustic characterization may be carried out using an anechoic chamber with a specialized microphone (e.g., from Brüel & Kjær company). A transducer array may be fabricated and controlled to implement a digital μLoudspeaker for a personal acoustical space. This DTAL device can be realized on silicon with improved characteristics from the current analog acoustic transducer. The acoustical transducer can be lighter, and can include a thinner structure and/or more power-efficient. Piezoelectric actuated MEMS speakers may be used in a variety of applications such as, e.g., hearing aid devices or earphones applications. It is possible to fabricate digital μLoudspeakers with enhanced performance and the desired characteristics of a thin and robust device that can be easily integrated into consumer electronics. Flat quality loudspeakers may reduce significate space in devices and equipment such as mobile devices (phones, laptops, etc.), desktop computers, and automobiles, etc. The device also allows sound directivity that can control the reproduced sound in a room, allowing multiple users to have a different and desired experience at the time of the reproduction. Moreover, the DTAL device can be adapted to behave as a sensor (e.g., a microphone), and/or an energy harvester.

PZT Diameter to Hole Ratio for Membrane Displacement

As previously discussed, the DTAL device 203 (FIG. 2) operates as follows: when a lower pressure is needed, fewer transducers 206 (FIG. 2) are activated and when higher pressure is needed, more transducers are used. Each transducer 206 contributes to a small pressure change in the system, which is a contribution of the total sound pressure change generated by the entire DTAL device 203. The response time of an individual transducer element depends on the digital clock that synchronizes the audio reconstruction process. Therefore, each individual device is independent of the reconstructed frequency and this enables the reconstruction of a wide range of frequencies. As a result, each membrane structure 303 (FIG. 3) does not need to operate in a specific frequency range, in contrast to the current design rules of loudspeakers.

A piezoelectric material (e.g., 309*c* of FIG. 3) can be used as the driving mechanism of the membrane structure 303, and polyimide (e.g., 309*a* of FIG. 3) as the structural material. Polyimide is a very attractive polymer for MEMS fabrication due to its low coefficient of thermal expansion, low film stress, lower cost than metals and semiconductors and high temperature stability compared to other polymers. Polyimide has been previously used in the microelectronics industry for module packaging, flexible circuits and as a dielectric for multi-level interconnection technology. Polyimide can be used as an elastic flexible substrate for polymer MEMS and as structural material for several other devices. As shown in FIG. 3A, lead-zirconate-titanate (PZT) can be used as the piezoelectric material 309*c* with bottom and top electrodes 309*b* using platinum (Pt), and a layer of polyimide as part of the structural material 309*a* of the bimorph actuator (or transducer) 206.

An optimized configuration for the largest displacement of the membrane structure 303 with the material layers of FIG. 3A. A piezoelectric module can be used to simulate the deflection of the membrane 303 with an applied voltage. The size of the piezoelectric material tri-layer (Pt/PZT/Pt) diameter and the opening (or hole) 312 where the membrane 303 is clamped can be varied. The results show the parameter that can be used is the ratio between the PZT diameter and the total diameter of the membrane.

Computational Methods.

The interaction of the mechanics and the electrical fields of the studied structure is called piezoelectricity. The interactions can be modeled as a coupling of the linear elasticity equations and charge relaxation time equations, using electric constants. Piezoelectricity can be described mathematically using the material's constitutive equations. Piezoelectric materials become electrically polarized when they are subject to a strain. In a microscopic perspective, the atoms displacement when the solid is deformed causes electric dipoles within the material. In some cases, the crystal structures can give an average macroscopic dipole moment or electric polarization. This effect is known as the direct piezoelectric effect. Also its reciprocal exists, the converse piezoelectric effect, in which the solid contracts or expands when an electric field is applied.

The constitutive relation between the strain and the electric field in a piezoelectric material is shown below (strain-charge form):

$$S=s_E T+d^T E$$

$$D=dT+\varepsilon_T E, \tag{1}$$

where, S is the strain, T is the stress, E is the electric field, and D is the electric displacement field. The materials parameters $s_E$,d and $\varepsilon_T$, correspond to the material compliance, the coupling properties and the permittivity of the material, respectively. These parameters are tensors of rank 4, 3 and 2, respectively. However, they can be represented as matrices within an abbreviated subscript notation, as it is more convenient to handle. In COMSOL Multiphysics, the piezoelectric device interface uses the Voigt notation, which is standard in the literature of piezoelectricity but differs from the defaults used in the Solid Mechanics interface. The latter relationship of equation (1) can be expressed in the stress-charge constitutive form, which relates the material stresses to the electric field:

$$T=c_E S-e^T E$$

$$D=dS+\varepsilon_s E. \tag{2}$$

The stress-charge form is usually used in the finite element method due to the useful match to the PDEs of Gauss' law (electric charge) and the Navier's equation (mechanical stress). Usually most material's properties are given in the strain charge form. The material properties $c_E$, e and $\varepsilon_T$ are related to the parameters $s_E$,d and $\varepsilon_T$, and can be transformed between each other by the conversion equations shown below:

$$c_E=s_E^{-1}$$

$$e=ds_E^{-1}$$

$$\varepsilon_s=\varepsilon_0\varepsilon_{r,T}-ds_E^{-1}d^T. \tag{3}$$

The piezoelectric equations used in COMSOL, combine the momentum equation, $$\rho_0\frac{\delta^2 u}{\delta t^2}=\nabla_x(FS)+F_v \tag{4}$$

with the charge conservation equation of electrostatics, $$\nabla\cdot D=\rho_V. \tag{5}$$

where the $\rho_V$ is the electric charge concentration. The electric field is computed from the electric potential V as:

$$E=-\nabla V. \tag{6}$$

In both equations (4) and (5), the constitutive relations of equation (3) are used, which makes the resulting system of equations closed. The dependent variables are the structural displacement vector u and the electric potential V.

Figure 10:
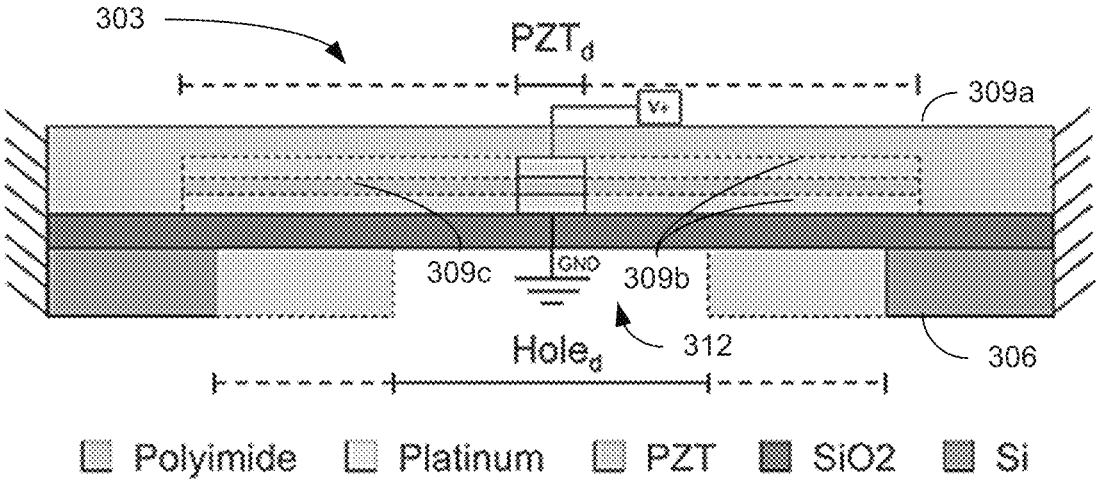
FIG. 10 is a cross-sectional view of an example of a membrane structure of FIG. 3A in accordance with various embodiments of the present disclosure.

Referring back to FIG. 3A, the components of the piezoelectric membrane are a 300 nm platinum (Pt) bottom electrode 309*b*, a 250 nm piezoelectric layer (PZT) 309*c*, a 300 nm Pt top electrode 309*a* and a 3 μm thick polyimide structural layer 309*a*, to complete the bimorph membrane 303. The membrane 303 is positioned in an opening (or hole) 312 of a silicon substrate 306. As can be seen in FIG. 3A, the dimensions of the piezoelectric actuator 206 are larger than the area of the hole 312. This is the parameter that can be optimized, for a larger displacement of the membrane 303. In the simulation, the piezoelectric module was used, whereby the membrane structure 303 was setup in a two-dimensional (2D) environment. The membrane structure 303 was simulated as a cantilever, which is clamped from both sides, as shown in FIG. 10.

For the mechanical constraints the six vertical boundaries (edges) to each side of the structure was set to be fixed. All the other boundaries were set to be free. For the AC/DC interface the bottom electrode was set to be the ground, and the top electrode was set to be a Terminal with a potential of 10V. A stationary study was selected and a parametric sweep was setup, to be able to change the geometry for different dimensions of the actuator. The PZT diameter dimension ($\text{Hole}_d$) will be constrained proportionally to the ratio "a", as shown by:

$$\text{PZT}_d=a*\text{Hole}_d. \tag{7}$$

Figure 11:
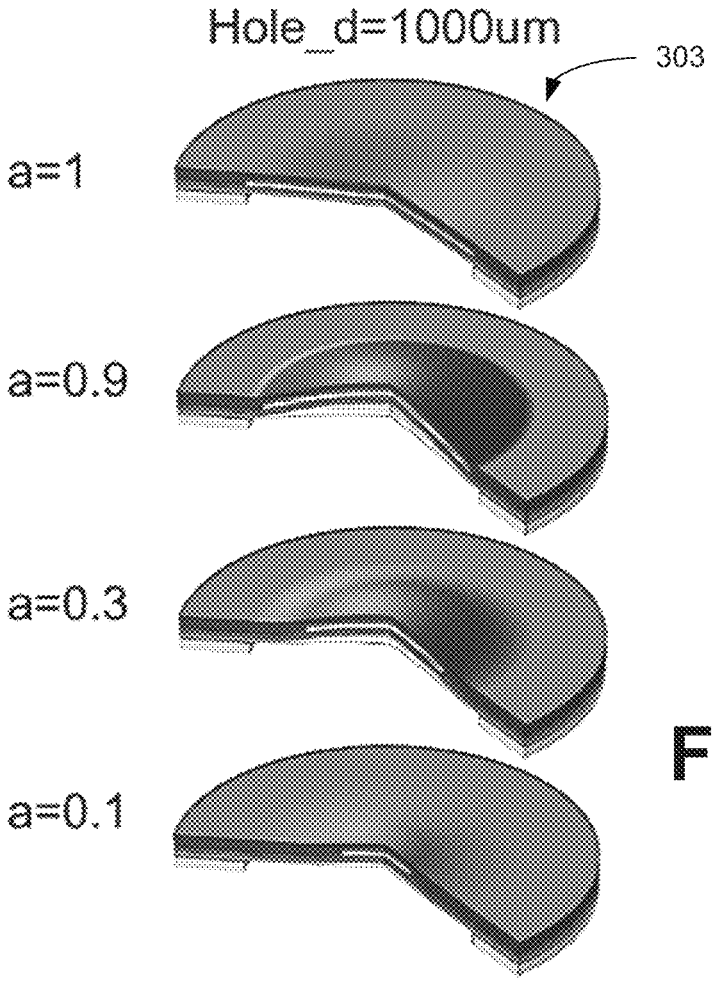
FIG. 11 illustrates simulation examples of the range of displacement of the membrane structure of FIG. 10 in accordance with various embodiments of the present disclosure.
Figure 12:
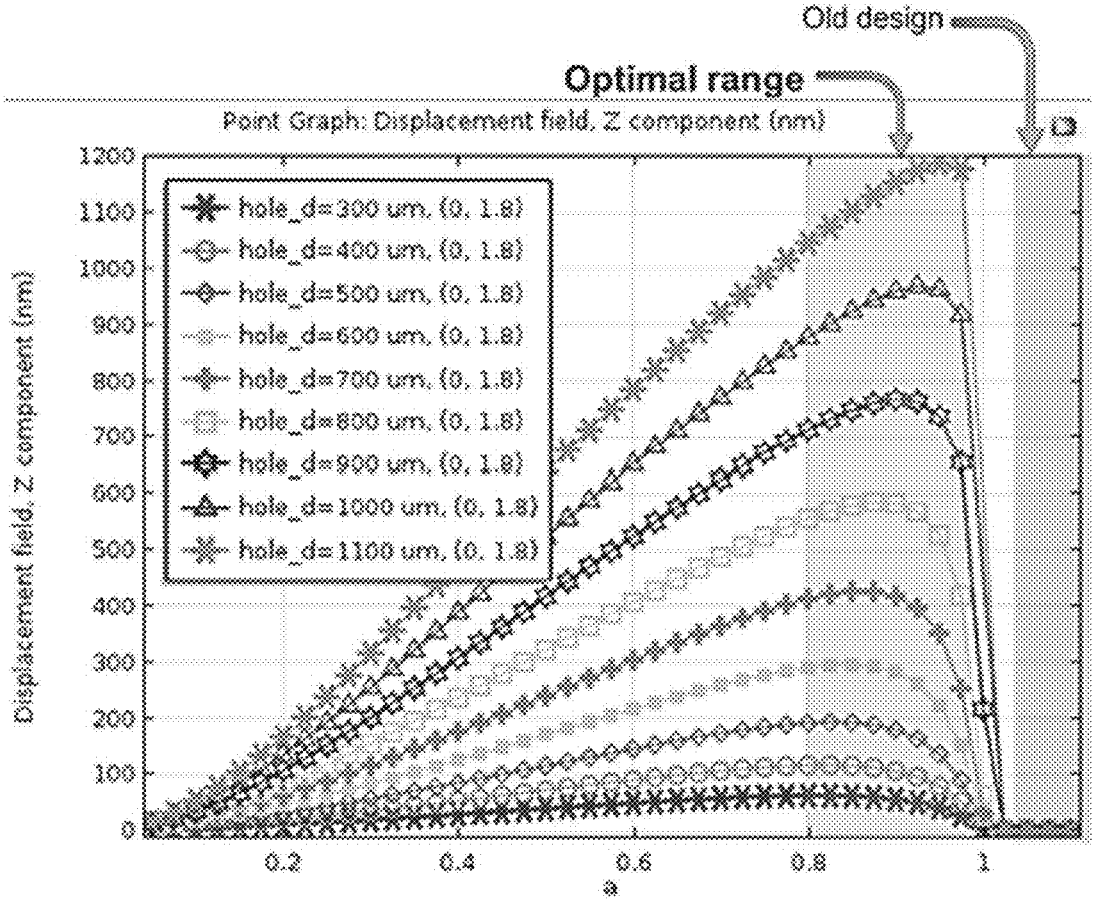
FIG. 12 is a graph illustrating examples of displacement vs diameter to hole ratio of the membrane structure of FIG. 10 in accordance with various embodiments of the present disclosure.

From the COMSOL simulation results, it was found that the original design was out of the optimal range for larger membrane displacement. In the original design, the range of displacement was in the range of hundreds of pico-meters. FIG. 11 shows a three-dimensional (3D) view produced from a revolution of the results. The 3D representation of FIG. 11 is from a partial revolution of the simulation results, showing the deformation of the membrane 303 and the internal layers. Referring to FIG. 12, shown is a plot illustrating the simulation results for the displacement vs diameter to hole ratio of the acoustic transducer 206.

Figure 13:
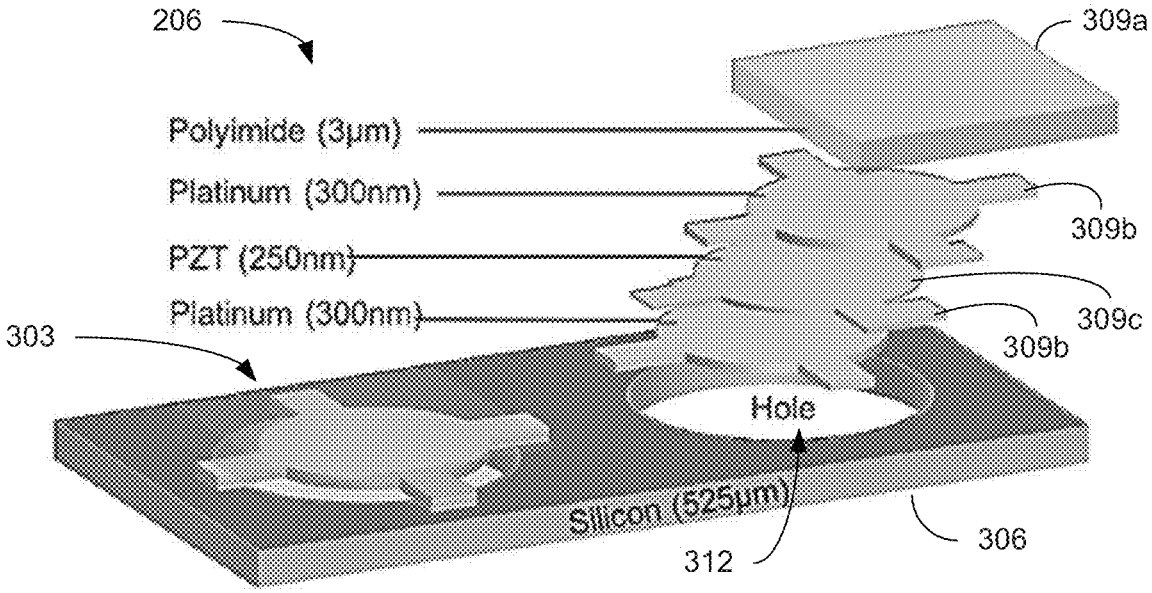
FIGS. 13, 14A and 14B illustrate examples of piezoelectric transducer structures in accordance with various embodiments of the present disclosure.

Based on the results of FIG. 12, the device was modified accordingly. FIG. 13 shows a modified version of the membrane structure 303 with the Pt/PZT/Pt layers (309*b*/309*a*/309*b*) optimized for displacement. As shown in FIG. 12, the desired PZT/Hole ratio "a" should be between 0.8 to 0.9 (i.e., the Pt/PZT/Pt layers (309*b*/309*a*/309*b*) have a diameter between 80%-90% of the hole diameter area). As seen in FIG. 13, the piezoelectric stack includes 4 arms that provide the interconnection with the next element in the DTAL device 203.

The design of FIG. 13 provides better performance of the array of actuators in the DTAL device 203. Chips were fabricated and diced from a four inch silicon wafer using a dicing method. The directivity of the beam forming pattern is a characteristic of the final transducer array. The DTAL device 203 can work as a directional loudspeaker, either using a digital sound reconstruction concept or by signal modulation using an ultrasonic signal, which can contain the audible signal. This characteristic can be utilized in a wide range of MEMS microloudspeaker applications such as, e.g., separate multi-user intensity and signal control of the audio source, private audio, medicine, and underwater communication.

MEMS Digital Parametric Loudspeaker

Digital sound reconstruction (DSR) and parametric loudspeakers (PL) are alternative methods of sound reproduction, which differ from traditional analog speakers. DSR comprises a system that allows the direct output of a digital audio signal, to an array of speaker membranes, without the need for a digital-to-analog converter. In a digital transducer array loudspeaker (DTAL) device 203 (FIG. 2), the transducers 206 are actuated following a bit group configuration. In this configuration, each individual transducer 206 can be assigned to a bit weight, and the number of transducers 206 in each bit group can be equal to the binary weighted bit. By following this method, a truly digital loudspeaker can be created because each bit in an audio file can be directly converted to sound pressure.

On the other hand, a PL comprises a modulated ultrasound carrier wave that can contain the information of a desired low frequency audible signal. When the ultrasound wave interacts with nonlinear materials (e.g., human ears), it can be "decoded", generating the desired sound in-situ. The nature of both of these methods allows the sound to travel with higher directionality than conventional analog loudspeakers. This can improve the audio quality by reducing existing problems such as bandwidth limitations and low linearity response of traditional systems.

Both technologies may revolutionize the way digital audio is experienced. For example, elderly adults who suffer from hearing conditions can benefit from the directionality of speakers using DTAL device 203. This can allow sound intensification in a small area within a room. Therefore, if two people are a few feet apart from each other, only one person will receive the higher sound level, without disturbing the other. Although this phenomenon occurs in both cases, the directionality of DTAL is strongly dependent on the array separation and on the audio frequency to be reproduced. On the contrary, PL offers a vastly more directional characteristic since the audio travels in a focused ultrasound beam whose propagation is independent of the audible information.

DSR chips using CMOS-MEMS membrane arrays have been presented as micro-speakers. The system included an array of 7 micro-speaker chips that were joined together to create a 3-bit array digital loud speaker. An 8-bit array with 255 MEMS membranes integrated on a single chip have been demonstrated. Likewise, different PL arrays have been reported, however their size is typically several centimeters Two different actuation principles, electrostatic and piezoelectric actuations are explored, which are suitable for DSR and PLs at the same time. The arrays presented here are designed to occupy an area as small as 16 mm by 16 mm, in which 1024 transducers can be packed in a single chip. This differs from previous reports in the actuation principle, array size, materials used, and fabrication method. Two distinct versions of the DTAL device 203 were fabricated: one using an electrostatic principle actuation and the other using a piezoelectric principle. Both versions used similar membrane dimensions with a diameter of 500 μm. These devices were the smallest micro-machined ultrasound transducer (MUT) arrays operated for both modes: DSR and PL. The chips included an array with 256 transducers, in a footprint of 12 mm by 12 mm. The total single chip size was 2.3 cm by 2.3 cm, including the contact pads.

Furthermore, an in-house micro-fabrication method is described where both devices use polyimide as structural material (e.g., 309*a* of FIG. 3). Two different fabrication processes were implemented for the devices. The first one is based on piezoelectric actuation, and comprises an array of circular membranes with a diameter of 500 μm. The second one is based on electrostatic actuation, and it has the same arrangement and membrane diameters. However, the membrane is a hexagon inscribed in the equivalent circle as the piezoelectric version. The electrostatic version uses gold electrodes and the piezoelectric version utilizes lead-zirconate-titante (PZT) and platinum (Pt) electrodes. The frequency response of the MEMS digital loudspeakers is presented, by measuring the frequency response of the actuators within the audible range.

Piezoelectric Membranes.

The piezoelectric transducers (e.g., 303 of FIG. 3A) were designed based on the D31 mode of the PZT piezoelectric material. This mode is known as the inverse piezoelectric effect, in which the piezoelectric material generates mechanical strain as a result of an applied electric field. This mode can be achieved by placing a PZT layer 309*a* (FIG. 3A) in between top and bottom electrodes 309*b* (FIG. 3A) using platinum (Pt). FIG. 3B shows a cross-section view for the D31 piezoelectric mode of the bimorph membrane structure 303. From an initial position of the membrane structure 303, a positive voltage applied between the electrodes expands the PZT layer causing a downward deflection as illustrated at the bottom and a negative voltage applied between the electrodes contracts the PZT layer causing an upward deflection of the structure as illustrated at the top.

The piezoelectric membrane presented here differs in the design of the tri-layer piezoelectric stack, but it uses the same arrangement of membrane arrays. The ratio between the membrane's hole 312 (FIG. 3A) and the piezoelectric layer stack 309*a*/309*b* (FIG. 3A) should be in the range of 0.75 to 0.9 to achieve a larger membrane deflection.

Figure 14A:
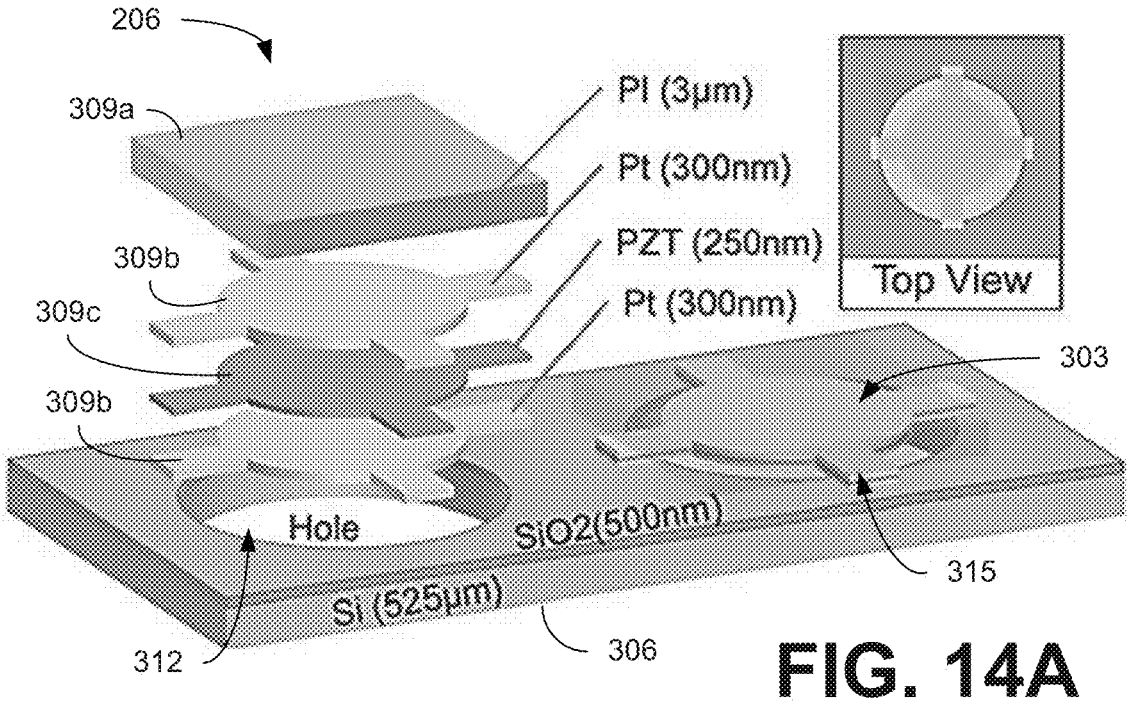

The fabricated design was a circular membrane structure with a nominal thickness of about 5 μm. The actuator membrane diameter is defined by the diameter of the hole 312 right underneath it, where the membrane 303 is fixed to the substrate frame 306 made by the hole 312. The central tri-layer membrane has four connection lines 315 along the circumferences positioned at 90° of each other, which will serve to interconnect the final transducer array. FIG. 14A shows a perspective and top views of a single membrane structure 303 for a D31 mode. The exploded view on the left illustrates the material components of the membrane and its nominal thickness.

The fabrication process for the piezoelectric actuator 206 can be summarized as follows:

(1) A 4-inch wafer was processed to thermally grow 500 nm of silicon oxide layer ($SiO_2$), which is used as a diffusion barrier and as an etch stop for the back through etch of the silicon substrate.

(2) The bottom Pt electrode 309*b* was deposited; this layer also aids the PZT crystal to grow with the desired crystal orientation.

(3) A PZT sol-gel solution was spun to a nominal thickness of 250 nm for the piezoelectric film 309*c*. The deposition used three cycles of coating and thermal annealing at 650° C.

(4) The top electrode 309*b* (300 nm Au/300 nm Pt) is deposited and patterned using a lift-off technique.

(5) The PZT is etched using the last patterned layer as a hard mask.

(6) A polyimide layer 309*a* is spun, cured and patterned with a thickness of 3 μm.

(7) Finally, a back through-etch is performed to the silicon substrate 306, after dicing the wafer into 9 chips with dimensions of 2.3 cm by 2.3 cm.

Figure 14B:
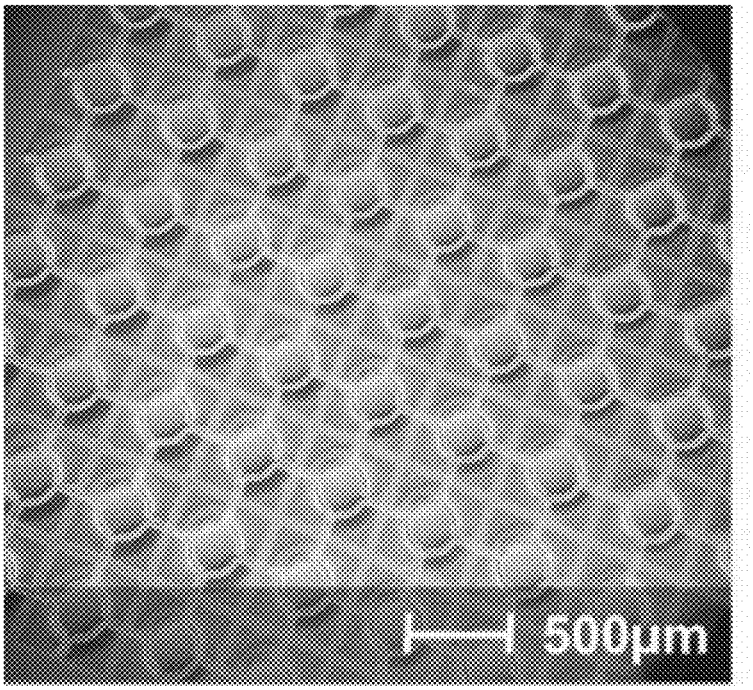

An optical microscope image of the final chip with piezoelectric actuator array (10-bit piezoelectric MUT transducer array) is shown in FIG. 14B.

Electrostatic Membranes.

Figure 15A:
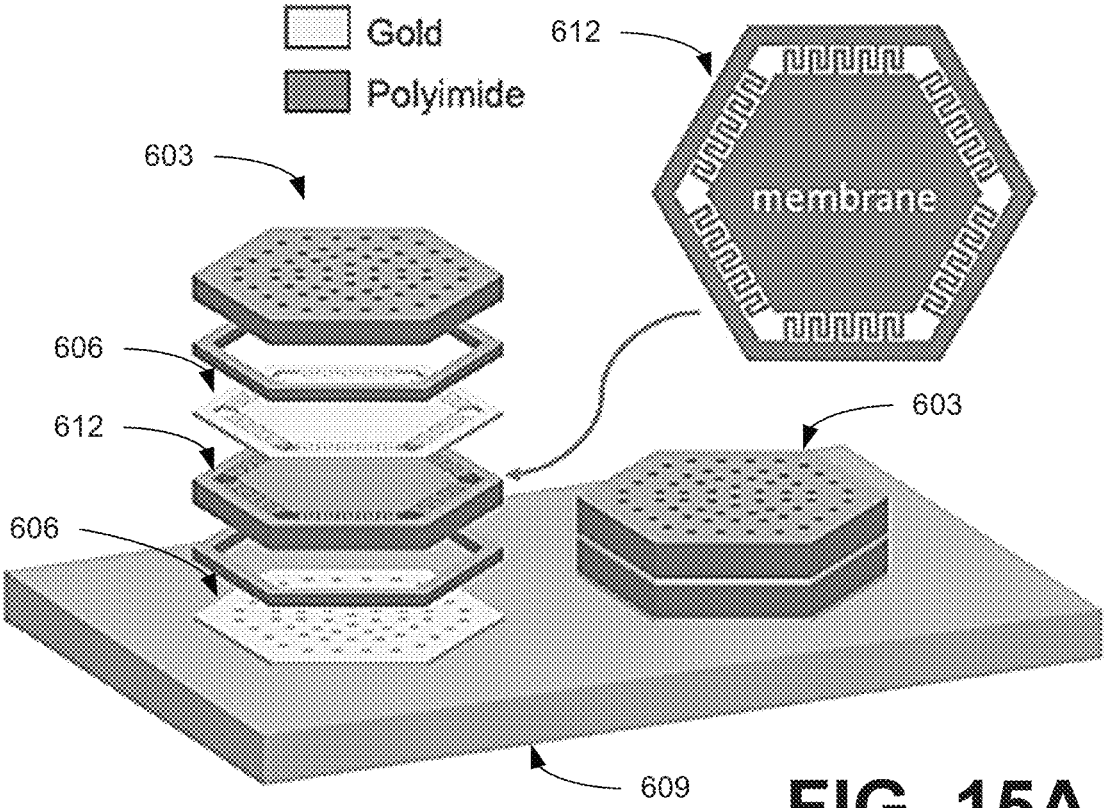
FIGS. 15A and 15B illustrate an example of an electrostatic micro-machined ultrasound transducer structure in accordance with various embodiments of the present disclosure.

The electrostatic devices were fabricated using a modified version of an in-house micro-fabrication process, the polyimide-metal MEMS Process (PiMMP). The electrostatic micro-machined ultrasound transducers (eMUT) 603 have a hexagonal shape, as illustrated in FIG. 15A, for optimization of the surface area of the membrane array in the chip. The exploded view of the electrostatic acoustic transducer 603 shows the components of the different layers.

Figure 15B:
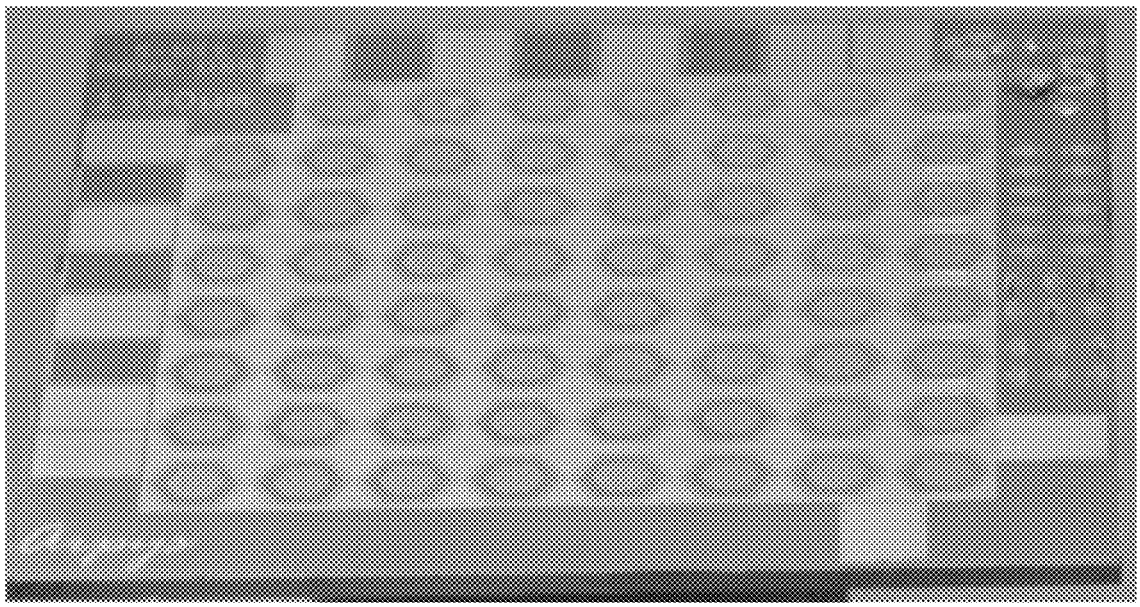

Two structural layers with their respective sacrificial layers are used to fabricate these multilayer micro-machined devices 603. These structural layers are made out of polyimide and have a nominal thickness of 5 μm each. Two gold electrodes 606 of 300 nm thickness are sputtered and patterned onto the substrate 609 and the polyimide membrane 612. This symmetric membrane design constrains the displacement of the membrane 612 in both directions, reducing the variability of the actuation. FIG. 15B is an optical photograph of the fabricated electrostatic acoustic transducer arrays. The chip size is 2.3 cm by 2.3 cm.

Figure 16A:
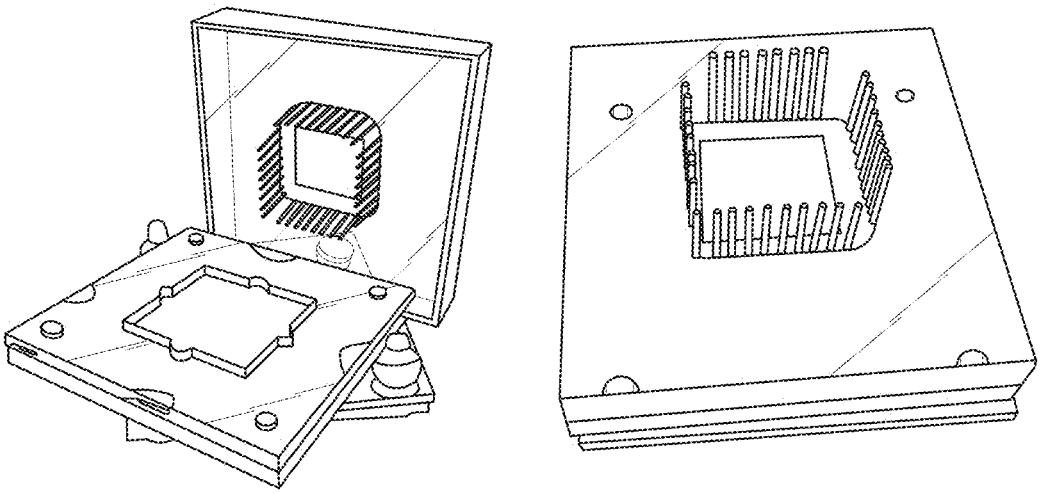
FIGS. 16A and 16B illustrate an example of a chip holder for testing in accordance with various embodiments of the present disclosure.

Initial characterization was done using a Cascade M150 probe station to check conductivity in the interconnections of the membrane arrays and a polytec laser Doppler vibrometer (LDV) to verify the motion of the membranes when applying a signal. However, subsequent measurements were obtained using an acrylic chip holder. The acrylic chip holder was fabricated using a Universal Systems $CO_2$ laser cutter, where conductive pogo pings were mounted on the structure. FIG. 16A includes optical photographs of the fabricated chip holder. The chip holder includes 8 pogo pins per side and an extra pin for ground for the current application.

This chip holder allows a more robust and flexible measurement setup. It helps to protect the chip from any contact with operator tools that could potentially damage the mounted test device. It also provides a reliable electrical connection to the device, with a solid contact between pogo pins and the electrode pads. As a result of the standardization in the setup and procedure, rapid access for characterization of different chips is possible without using wire bonding techniques or movable probe tips.

Figure 16B:
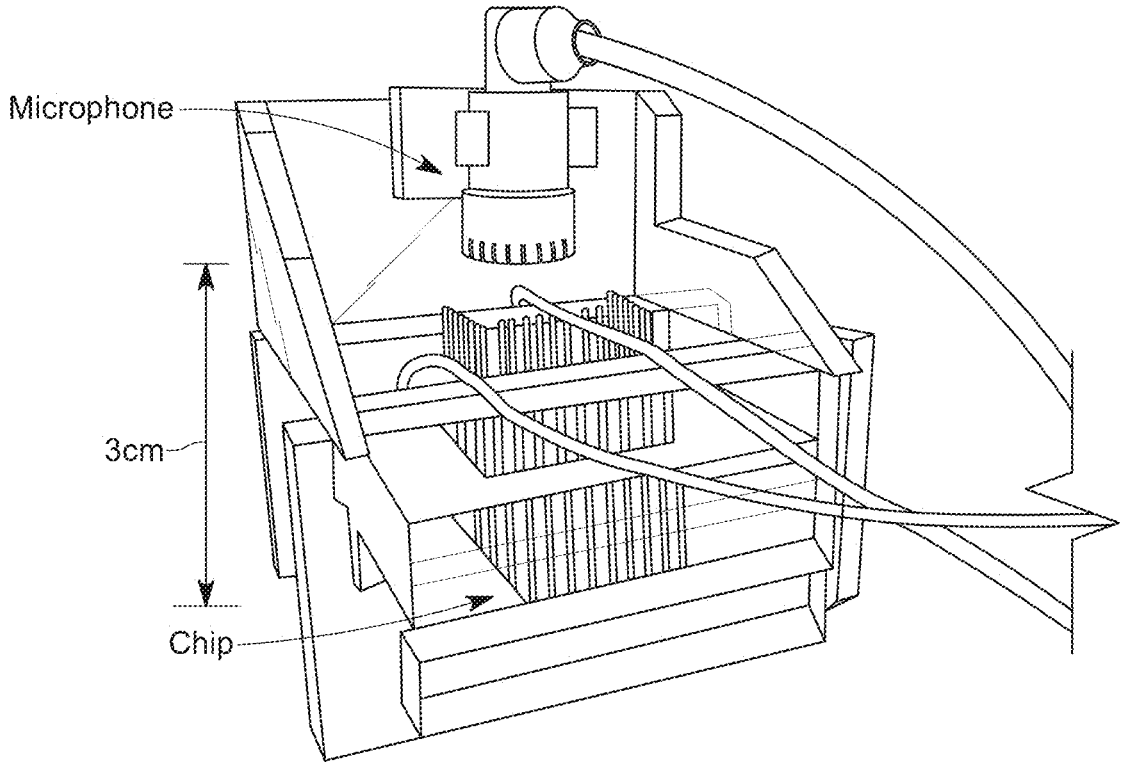

The acoustic measurement of the actuator arrays was done using SoundCheck software from ListenInc. The software sent a stimulus signal using the RME FireFace UC sound card that was connected via an USB port. The sound card was connected from the selected balanced output to a calibrated power amplifier using a ¼-inch TRS to BNC cable. The amplifier's output is connected directly to the MUT chip that was located inside a Brüel & Kjær Anechoic Test Box 4232. A Brüel & Kjær 4189 ½-inch free-field microphone read the generated sound from the chip, which was positioned 3 cm above the device under test (DUT) inside the anechoic box. FIG. 16B is an image of a DUT inside the anechoic test box, showing the position of the Brüel & Kjær free-field microphone.

The microphone was connected to a preamplifier using a BNC connector and the preamplifier output was connected using a BNC to ¼-inch TRS cable back to the Fireface UC soundcard input. SoundCheck software analysed the returned input signal from the predefined analysis sequence. The excitation signal generated by the soundcard was a sinusoidal frequency sweep from 50 Hz to 20 kHz (audible spectrum).

Figure 17:
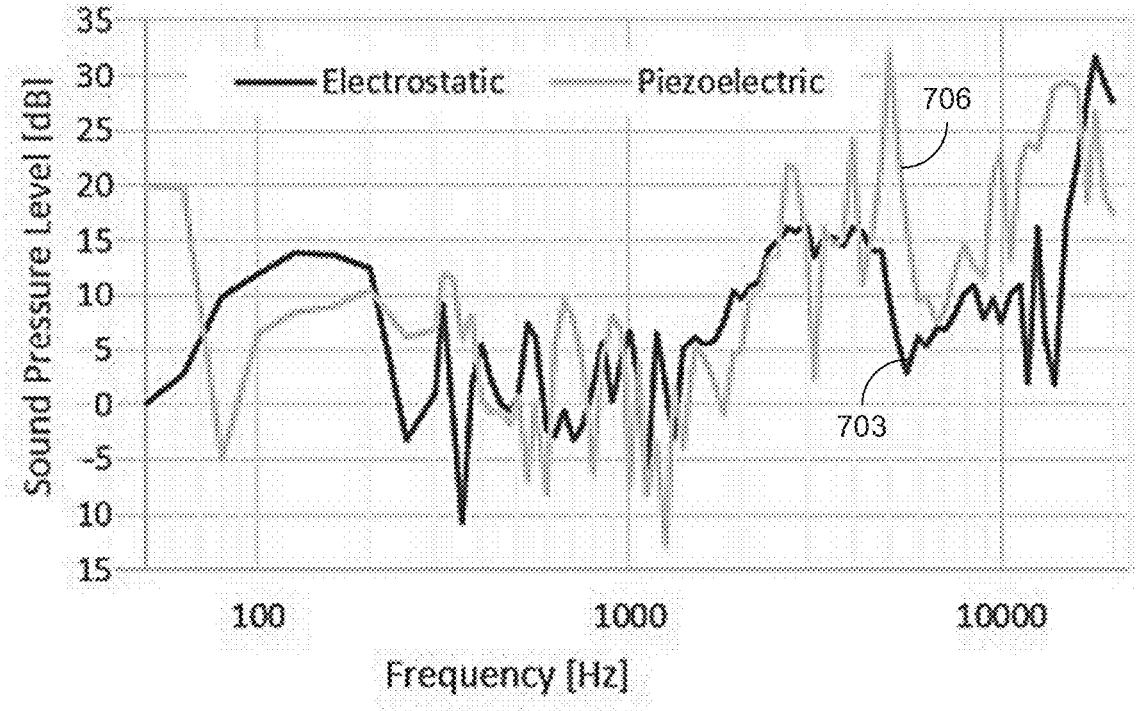
FIG. 17 is a graph illustrating the frequency response of the actuator arrays testing in accordance with various embodiments of the present disclosure.

Both electrostatic and piezoelectric MUT's were measured using the same setup, at different voltages. To find their highest possible output, all of the membranes were actuated simultaneously. For the electrostatic actuator array, the excitation voltage was 95 V and the piezoelectric actuators used a voltage of 3 V, where the maximum amplitude was reached. The measurements for the electrostatic actuator 703 and piezoelectric actuator 706 are shown in the plot of FIG. 17, which illustrates the frequency response of the actuator arrays in the audible range (50 Hz to 20 kHz), expressed in sound pressure level (SPL), using 20 μPa as reference pressure. As can be seen, both actuator types have an irregular response and both increase their amplitude as the excitation frequency increases. Since both DSR and PL actuate only on a single high frequency, the response of the actuators indicates that they are suitable for these applications.

Both actuators produce very similar sound pressure levels (SPL), ranging between −10 dB at the mid frequencies, and 25+ dB at the higher range. This was expected, since both actuator arrays have similar total membrane surfaces (about 50.3 $mm^2$ for the piezoelectric and about 41.6 $mm^2$ for the electrostatic), and both were measured at their maximum volume. Despite their similarities, the large difference in the voltage needed to obtain the same SPL puts the piezoelectric actuators at a greater advantage in feasibility for integration with other electronics. The two different actuator arrays are suitable for DSR and PL methods of sound reproduction. These MEMS based loudspeakers exhibited larger sound pressure levels at high frequencies, which is desirable for both cases.

In the DSR mode, either the electrostatic or the piezoelectric membranes, may produce high frequency pulses following the Nyquist criterion in order to adequately reconstruct an audible signal. Similarly in the case of the PL operation mode, it is also desirable to obtain larger sound pressure levels at high frequencies in order to generate the ultrasound carrier wave, which transports the audio information. Although the frequency measurements only fell within the audible range (20 Hz to 20 kHz), the characterization showed promising results that indicate that the transducers can perform suitably at high frequencies.

Both actuator arrays produced sound pressure levels of the same magnitude, which was expected based on their similar membrane dimensions. However, the piezoelectric actuator uses a driving voltage one order of magnitude lower than the electrostatic transducers, putting it at a greater advantage. Integration of a control unit, the development of integrated circuits and device packaging may be carried out. These devices may be implemented in applications such as, e.g., underwater communication systems, personalized speakers integrated in thin consumer electronics (e.g. Smartphones, displays, tablets, headphones), and localized audio spotlights.

MEMS Electrostatic Acoustic Pixel

The simulation of a hexagonal membrane structure using COMSOL Multiphysics 5.0 is presented. The structure includes a 5 μm thick polyimide layer with an integrated metal layer on top, to apply a bias voltage. The hexagonal membrane is separated by a 3 μm air gap and 5 μm thick polyimide structural layer from the bottom electrode and a 3 μm and 5 μm thick polyimide structural layer from the top electrode. The AC/DC Module was used to extract the capacitance and pull-in voltage needed to displace the membrane toward the active electrode. A modal analysis was performed using the Structural Mechanics Module to extract the structure's resonance frequency and frequency modes.

COMSOL Multiphysics provides the electrostatic interface, which is available for 3D, 2D in-plane and 2D axisymmetric components. In this application, a capacitor will use relatively high voltage (up to 150 Volts). The electrostatic equations are not to be taken literally as "statics", but as the observation or time scale at which the applied excitation changes are in comparison to the charge relaxation time, and that the electromagnetic wavelength and skin depth are very large compared to the size of the domain of interest.

For the electrostatic device, the quasi-static electric fields and currents that are included in the MEMS module can be used, together with the AC/DC module, which do not include the wave propagation effects. The physics interfaces takes only the scalar electric potential, which can be interpreted in terms of the charge relaxation process. The three equations used for this physic are: the Ohm's Law, the equation of continuity and the Gauss' law. COMSOL combines this equation and uses the following differential equation for the space charge density in a homogeneous medium:

$$\frac{\delta\rho}{\delta t} + \frac{\sigma}{\varepsilon}\rho = 0, \tag{8}$$

with solution:

$$\rho(t) = \rho_0 e^{\frac{-t}{\tau}}, \tag{9}$$

where $$\tau = \frac{\varepsilon}{\sigma}, \tag{10}$$

which is the charge relaxation time. When using a good conductor material such as gold, t is of the order of $10^{-19}$ s, whereas for a good insulator like silicon oxide, it's of the order of $10^3$ s. It is the relation between the external time scale and the charge relaxation time that determines the physics interface and study that will be used.

Under static condition the potential, V, is defined as the following relationship:

$$E = -\nabla V. \tag{12}$$

When combined with the constitutive relationship D=εE+P between the electric displacement D and the electric field E, the Gauss' law is represented as:

$$-\nabla\cdot(\varepsilon_0\nabla V - P) = \rho \tag{13}$$

Equation 13 describes the electrostatic field in dielectric materials, the physical constant $\varepsilon_0$ is the permittivity of vacuum with units [F/m], P is the electric polarization vector in [C/m$^2$], and r is the space charge density given in [C/m$^3$].

For models in 2D, the interface assumes a symmetry where the electric potential varies only in the x and y directions and is constant in the z direction. Which implies that the electric field E is tangential to the xy-plane. The same equation can be solved in the case of a 3D model. The interface solves the following equation where d is the thickness in the z direction:

$$-\nabla\cdot(\varepsilon_0\nabla V - P) = \rho. \tag{14}$$

The axisymmetric version of the physics interface considers the situation where the fields and geometry are axially symmetric. For this case, the electric potential is constant in the ϕ direction, implying that the electric field is tangential to the rz-plane.

Figure 18A:
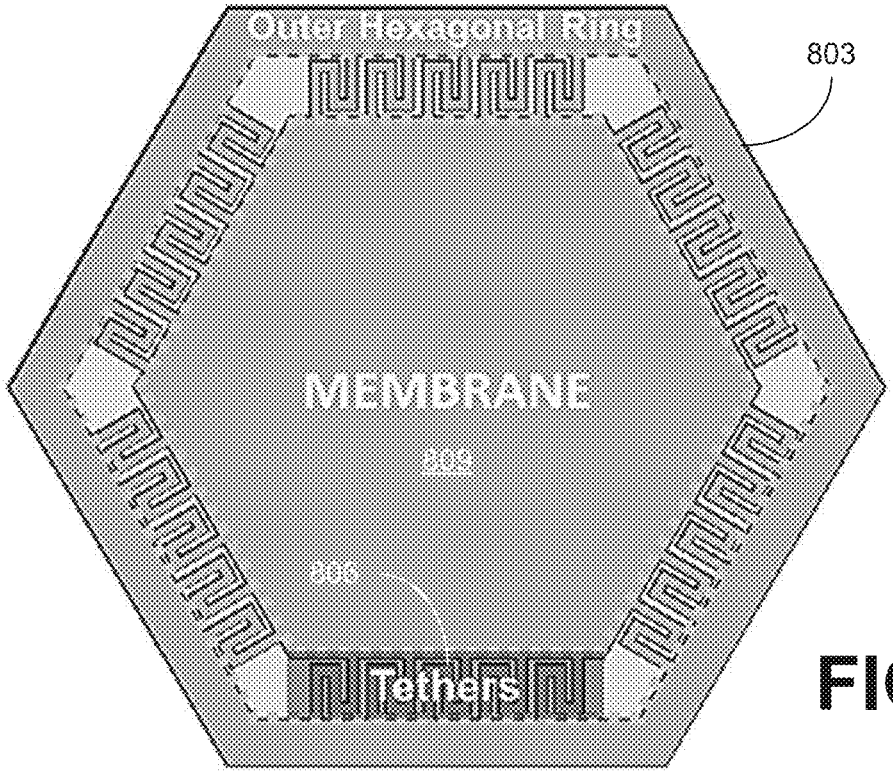
FIGS. 18A through 18C illustrate an example of an electrostatic hexagonal transducer structure in accordance with various embodiments of the present disclosure.

The main membrane of the electrostatic device can be divided in three sections: outer hexagonal ring 803, tethers 806 and hexagonal membrane 809. FIG. 18A shows a top view of the simulated membrane. The electrostatic device was evaluated with several different tether designs and the present disclosure uses a final chosen design for fabrication. The design included five tethers 803 in each side of the hexagonal membrane 809. The standard structure had the following dimensions: 250 μm membrane hexagon side, the hexagon was inscribed in a 500 μm diameter circumference and tethers 806 have a width of 8 μm for each of them.

Figures 18B, 18C:
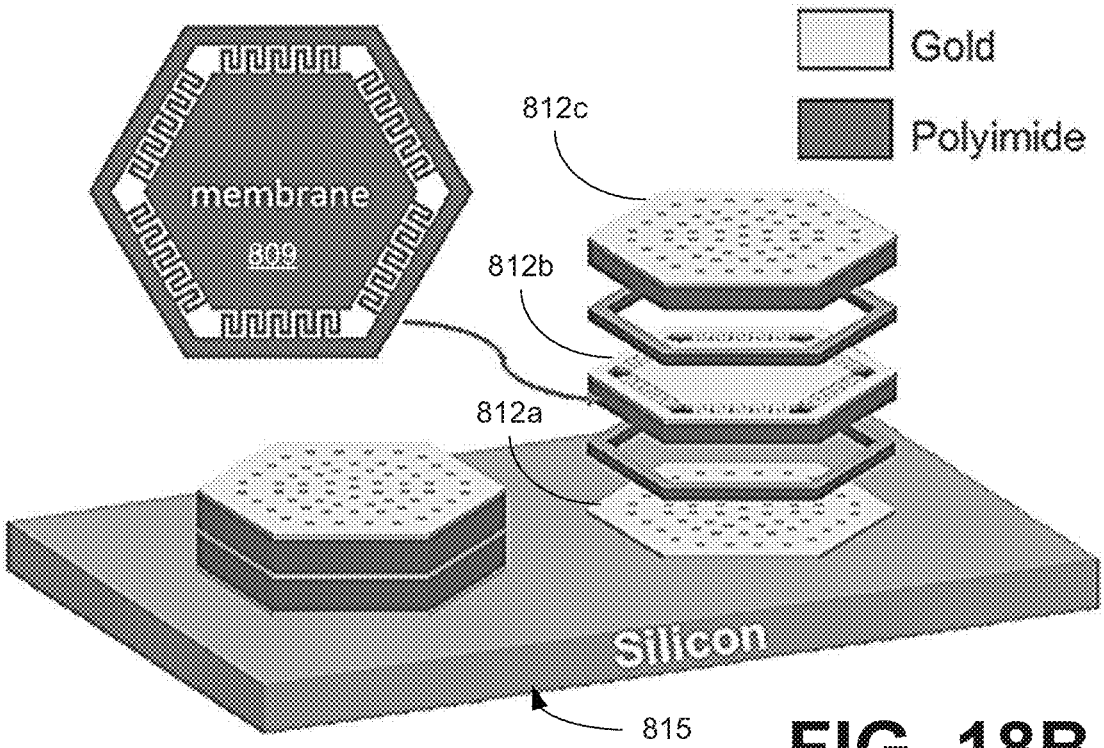

Referring to FIG. 18B, shown is an example of a device with an individual membrane 809, with an exploded view on the right and an assembled view on the left. The structure can be fabricated using two structural layers and two sacrificial layers. The structural layers were made of polyimide with a thickness of 5 μm. To be able to attract and repel the membrane 809, a set of electrodes 812 are used. In the simulations, the bottom electrode 812*a* was made of gold, because of its good conductivity, which is located right on the silicon substrate 815. Also included are a middle electrode 812*b*, which is on top of the membrane 809, and a top electrode 812*c* that is all the way to the top of the structure.

To create the 3D model in COMSOL, the 2D layout was first exported from Tanner L-edit software, which is the tool used to design the devices for in-house micro-fabrication. The CAD import module was used, and the correct scale was set to import the DXF file into COMSOL environment. The import was done in two different work-planes to be able to extrude the needed features. The final component was set to form composite faces to eliminate unnecessary features and a union operation. The selected materials for the electrodes 812 was gold and the structural layer was set to be polyimide. Also, all the gaps were set to be air. The table of FIG. 18C lists the material properties used in the simulation.

The electromechanics physics module was setup with the following constraints: a fixed constraint for all the six outer sides (faces boundaries) of the full structure, the bottom electrode 812*a* was the ground and the middle electrode 812*b* was a terminal. The setup allows the interaction between the electrodes 812, and the capacitance was calculated by the software. An interesting feature of the simulated design is that there will not be an electric short when pull-in occurs, because all the electrodes 812 were completely isolated from each other with a structural layer. To see the behavior of the membrane 809, a stationary study was used with an auxiliary sweep to apply voltages between a pair of electrodes 812 ranging from 10V-150V in steps of 10V. The boundary that was set to be the terminal (electrode 812*b*) was given the declared parameter "Vin".

Figure 19A:
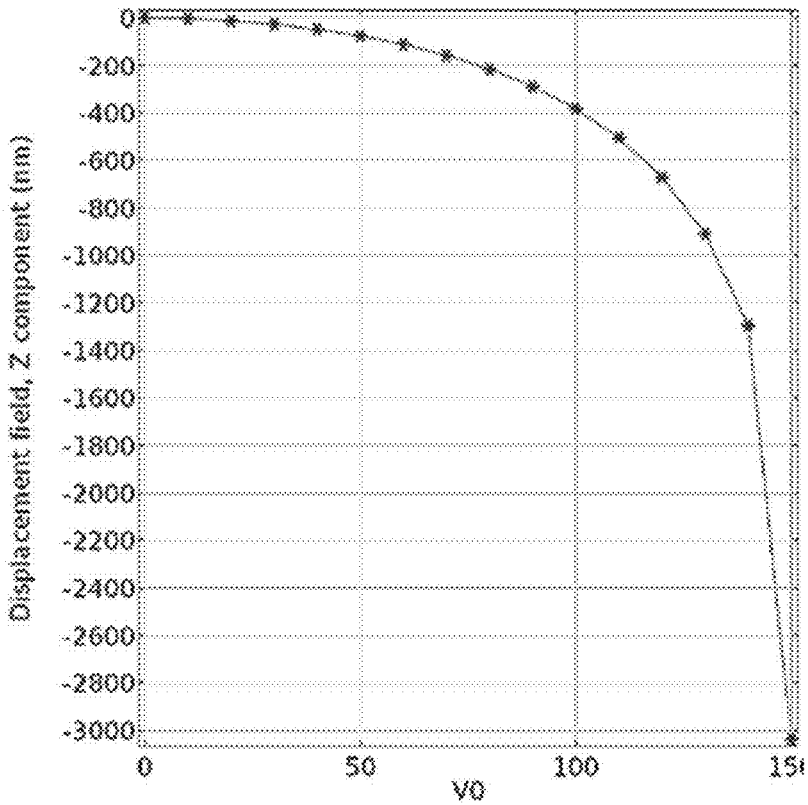
Figure 19B:
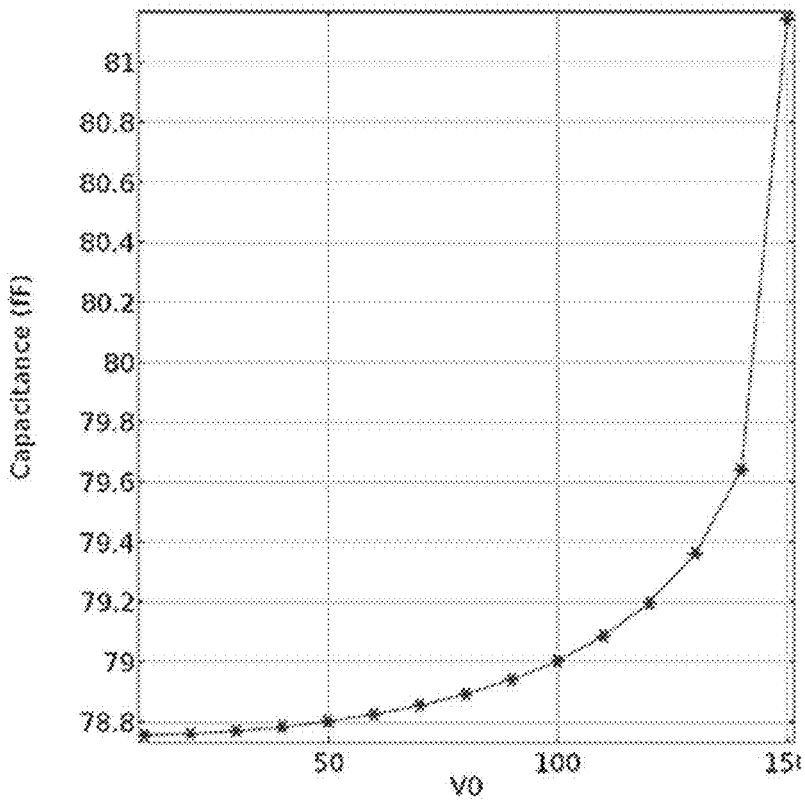

The simulation results provide an insight of the deformation of the membrane 809. The pull-in voltage when the system is unstable happens at about ⅓ of the distance between the electrodes 812. Therefore, the pull-in occurs when the membrane 809 moves approximately 2:6 μm towards the active electrode (electrode 812*b*). In FIG. 19A, a graph of the simulated displacement (total displacement on the z-axis) vs. the applied voltage is shown, and FIG. 19B shows the graph of the capacitance between the electrodes 812 vs the applied voltage.

Figure 19C:
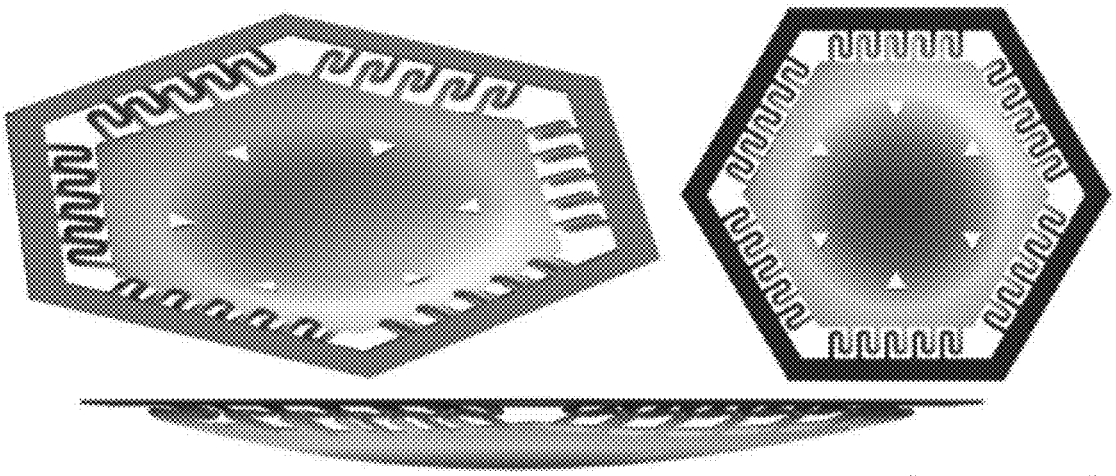
Figure 19D:
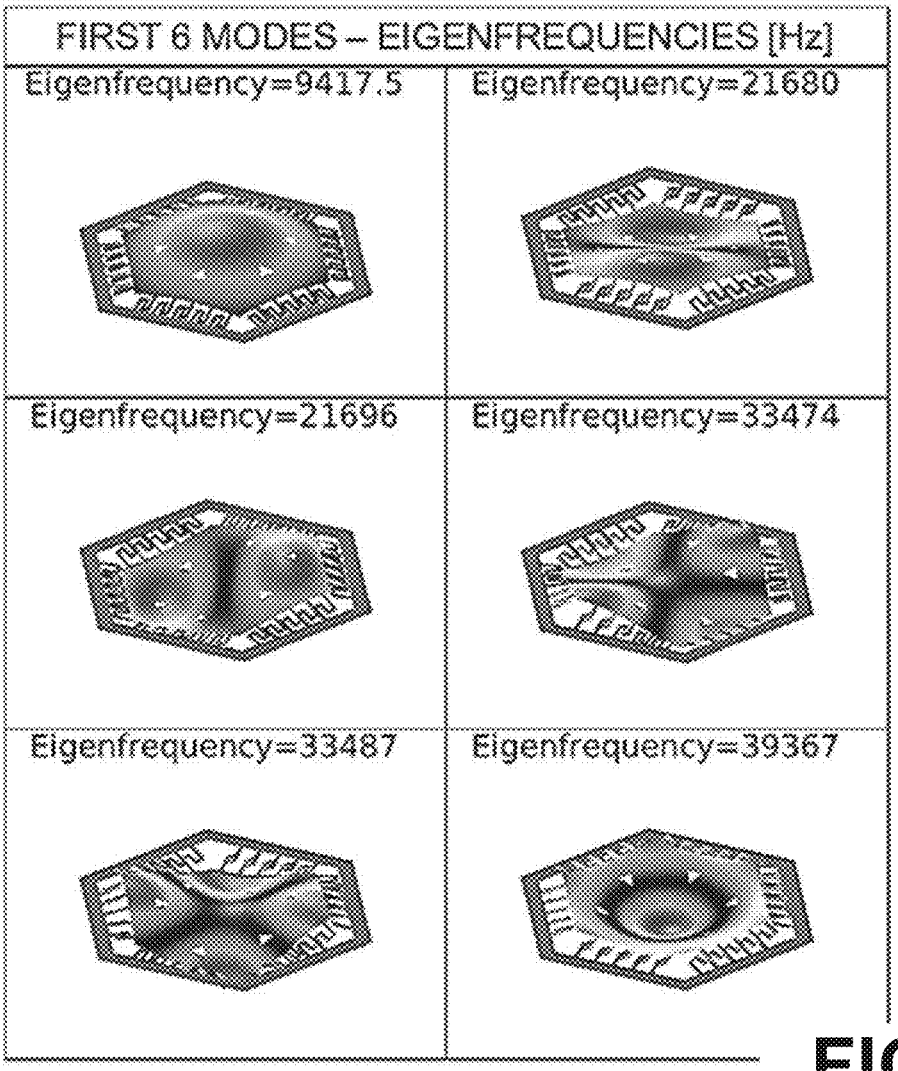

From these results, it was possible to deduct that the pull-in voltage was between 140V and 150V, and applying more than this voltage won't allow the simulation to converge. FIG. 19C illustrates examples of the results of the displacement in the 3D model. The top left image is an isometric view of the simulation results for displacement, the top right image is a top view of the deformed structure, and the bottom image is a side view of the deformed structure at 150V. The resonance frequency and mode frequencies were calculated using the solid mechanics module to study the behavior of the structure. An Eigenfrequency study was setup to find the first 6 frequency modes of the simulated structure, which are shown in FIG. 19D.

From the simulation results, it can see that the mode of interest is the first one at 9.4175 kHz, as this will displace the air in a uniform mode with only one deformation node. Since the transducer will be actuated at an expected sample frequency of 40 kHz, the closest mode is the sixth at 39.267 kHz. Mode 6 has one radial node and one central node, but it will not have an impact on the performance of the membrane 809 because it will be out of the range of the frequency.

If the membrane is actuated at 40 kHz, the input signal will behave as a pulse with a width of 25 μm. Therefore, a new simulation was performed with a time dependent study from t=0 to t=625 μs in steps of 25 μs to observe the response time of the structure to a 150 V constant electric potential applied to one of the electrodes. FIG. 19E, shows the response time of the membrane 809 to the input signal of 150 V. From this graph, it can be seen that it takes the membrane 809 about 125 μs to reach the maximum displacement of about 1.5 μm. Also, it can be seen that if the membrane 809 reaches a stable position in about 500 μs at 1 μm displacement from its original position. Nevertheless, the pulses will only be 25 μs long, which means that the structure will only displace about 0.5 μm.

The membrane design was simulated with intended operational voltages for the fabricated device. The results showed that the membrane 809 is suitable for the acoustic transducer element of the final transducer array. The membrane geometry can be adjusted to change the resonance frequency of the structure, so that the element has an optimal acoustic response for its application. With the total displacement of the structure at an applied voltage, the displacement can be simulated and the sound pressure generated by this change calculated. Full arrays have been designed and fabricated. The processed chips were diced from a four inch wafer using an in-house dicing method.

Micromachining Process for MEMS Applications

Polyimide is a very attractive polymer for MEMS fabrication due to its low coefficient of thermal expansion, low film stress, lower cost than metals and semiconductors and high temperature stability compared to other polymers. Polyimide has been previously used in the microelectronics industry for module packaging, flexible circuits and as a dielectric for multi-level interconnection technology. Recently, the polymer has been widely used as an elastic flexible substrate for polymer MEMS and also as structural material for several devices.

An expanded multi-user fabrication process is described here that extends the array of demonstrated applications. The use of three metallization layers, their interconnectivity, and the ability to place a dielectric (polyimide and air) between them, opens up possibilities to fabricate a great variety of electrical transducers. Principles such as: electrostatic actuation, thermal bi-morph actuation, capacitive sensing, fabrication of coils for magnetic applications, thermoelectric sensing due to the interaction of different metals, and fabrication of antennas for transmission and reception.

The disclosed multi-user micro-fabrication process differs from commercially available MEMS foundry services such as PolyMUMPs®, in particular on the materials used, the layer arrangements, fabrication cost, and the set of design rules. Moreover, the fabrication process provides electric routing to all metallization layers, from the top metal layer to the bottom in order to create not only stable contact pad patterns on the substrate, but also potential active electrodes for specific applications.

Figure 20B:
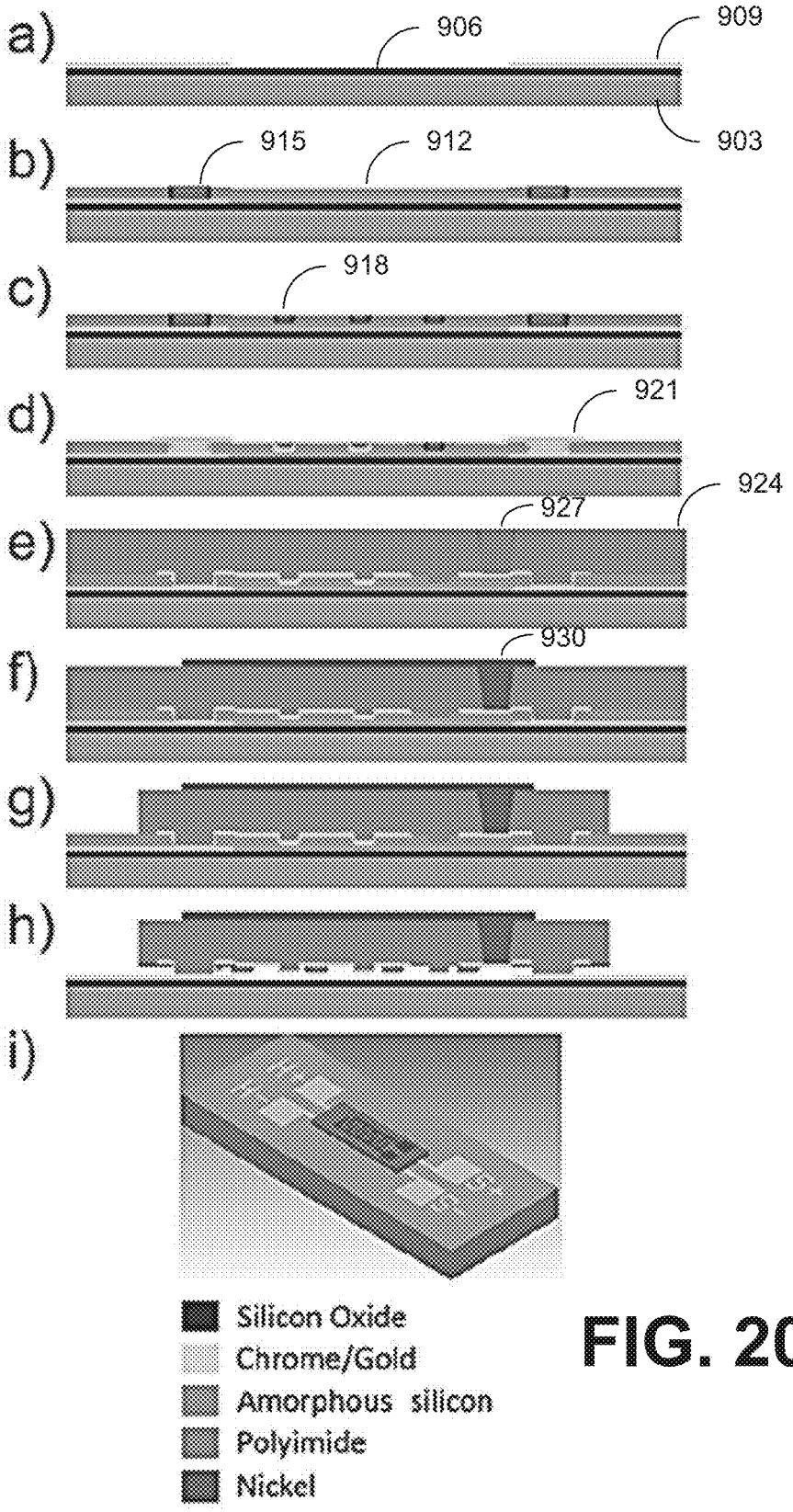

The micro-fabrication process involves various surface micro-machining steps, which includes seven photolithography levels and six physical layers. The set of masks that can be used for fabrication are listed in the table of FIG. 20A and the micro-fabrication process sequence (a-h) is shown in FIG. 20B. All fabrication steps can be performed in a cleanroom environment.

The process starts with a 4-inch single-side polished silicon wafer (or substrate) 903, on which a thermal oxidation step is performed. A 500 nm thick oxide layer 906 can be grown using a dry-wet-dry cycle in a furnace at 1100° C. This layer 906 can be used as insulation between the substrate 903 and the fabricated devices. Next the pattern of the first metallization layer 909 is formed using, e.g., a lift-off technique (see (a) of FIG. 20B). This layer 909 can be used for the contact pads and labeling of the fabricated devices. Gold (Au) can be used because of its chemical inertness and good conductivity. The material can be used for the contact pads and interconnection lines in several stages throughout the fabrication process. Despite of its good characteristics, golds adhesion to other materials (e.g., silicon, silicon dioxide, polymers, among others) is very poor. This can be overcome by adding a thin adhesion layer such as, e.g., Chromium (Cr), prior to the gold deposition. The metal layer 909 can be patterned using a lift-off technique, in which ECI-3027 photoresist is first spun, exposed to 180 mJ/cm$^2$ energy using, e.g., the "METAL_0" mask (FIG. 20A) and then developed using the AZ 726 developer. Before the metal sputtering, an oxygen plasma descum can be performed to remove any residues of the developed resist, to ensure a good adhesion to the substrate 903. A metal bi-layer of 50 nm thick Cr and 300 nm thick Au can be deposited using a physical vapor deposition (PVD) sputtering system. The photoresist can be removed in an acetone bath until the metal pattern is clear. The wafer is rinsed with acetone and isopropanol alcohol (IPA) and put on a hotplate at 120° C. for a dehydration bake.

Plasma-enhanced chemical vapor deposition (PECVD) can be used to deposit a 2 μm thick amorphous silicon (α-Si) film 912 as the sacrificial material. The deposition can be done at 250° C. using silane in an argon environment (10% SiH4 in Ar) as the reactant gas. A standard photolithography step can be followed to pattern the anchors 915. A 4 μm thick photoresist (ECI3027) can be spun and exposed to 180 mJ/cm$^2$ of energy using the "ANCHOR" mask (FIG. 20A) and then developed. Before etching the silicon, an oxygen plasma descum can be performed to get rid of any residual resist left. A reactive-ion etching (RIE) tool PlasmaLab System 100 from Oxford Instruments can be used for this. Both recipes can be used in the same etching tool without breaking the vacuum. After etching, the resist is removed in an acetone bath. Item (b) of FIG. 20B shows the wafer with the anchors 915 already patterned. The anchor features allow the structures to be directly fixed to the silicon oxide and also provide access to interconnect the contact pads patterns down to the "METAL_0" and other successive metallization layers.

Next, dimples 918 are patterned, which is a similar etch to the anchors 915. Dimples 918 should be small by design and can vary depending on the structure's needs. These features can be useful to prevent the stiction phenomena between the free-standing structures and the substrate 903 after the devices are released. To create the dimples 918, an etch can be performed to the sacrificial layer of approximately 1 μm, as shown in item (c) of FIG. 10B. A similar photolithography as that used to pattern the anchors 915 can be used, but with a reduced etch time. These indentations on the sacrificial layer will serve as a mold for the structural layer. The photoresist mask can be stripped with acetone, rinsed with acetone and IPA for 60 seconds, and a dehydration bake done to the wafer.

A second metal layer 921 can next be patterned. Similar to the lift-off technique used for the first metallization layer 909, first spin the (ECI 3027) 4 μm photoresist, expose with the "Metal_1" mask (FIG. 20A) and develop to get the pattern. The wafer can be put to a descum step to remove any unwanted organic residues and then can be sputtered with a Cr/Au/Cr (50 nm/250 nm/50 nm) layer. The wafer can be put in an acetone ultrasonic bath to finish the lift-off, then rinsed with acetone and IPA and baked at 120° C. for the dehydration bake, as shown in item (d) of FIG. 20B.

At this point, the wafer is ready for the structural layer coating 924. Prior to spinning the polyimide PI-2611 (HD Microsystems), an adhesion promoter can be applied to the wafer, e.g., dilute 1 mL of VM-651 in 1 liter of DI water. The wafer can be submerged in the solution for 40 seconds and then dry blown with nitrogen ($N_2$). After the adhesion promoter is applied, the polyimide can be spun for 5 seconds at 500 rpm to coat the wafer's surface and then ramped to 3000 rpm for 40 seconds to get a final thickness of 6 μm. The film 924 needs two soft-bakes steps on a hotplate: the first at 90° C. for 90 seconds and followed immediately by the second at 150° C. for another 90 seconds.

The film 924 can then be cured. This can happen on the same hotplate from the last soft-bake. The hotplate can be programmed to increase the temperature from 150° C. to 350° C., with a rate of 4° C./min. There can be a hold at 350° C. for 30 minutes and then the heat can be turned off, to gradually cool down the wafer to room temperature. Once the structural layer 924 is cured, a 300 nm gold layer can be deposited using a lift-off technique with the "M1_M2_VIA" mask (FIG. 20A). The gold layer can be used as a hard mask to open the via-holes 927 on the structural layer, so that the previous metal layers 909/921 are exposed to connect with the last metallization layer 930, as shown in item (e) of FIG. 20B. Then a wet etch can be used to remove the gold hard-mask. Now the "Metal_1" mask (FIG. 20A) physical layer can be exposed. The 50 nm layer of Cr can be wet etched to expose the Au layer that is used as the seed layer. The wafer can be put in a bath with an electroless nickel solution to fill in the opened via-holes 927.

Subsequently, a lift-off technique can be used to pattern the last metallization layer 930. A 500 nm layer of nickel (Ni) can be deposited on the patterned photoresist. The wafer can be soaked in an acetone bath until the photoresist and metal residues are gone, leaving the predefined pattern of the "Metal_2" mask (FIG. 20A), as shown in item (f) of FIG. 20B. The structural layer pattern can be defined using a similar procedure as that used when opening the via-holes 927. First pattern 300 nm of sputtered Au, using lift-off technique and using the "Structural" mask (FIG. 20A). Then this Au pattern can be used as a hard mask to dry-etch the polyimide layer 924, using reactive ion etching (RIE), as shown in item (g) of FIG. 20B.

Finally, the wafer can be diced into chips (e.g., 40) with dimensions of 12 mm×12 mm, using an automatic dicing saw or using another low-cost dicing technique. Once the chips are separated, the individual chips can be released with a dry-etch technique, using xenon di-fluoride ($XeF_2$) to etch the α-Si, as shown in item (h) of FIG. 20B. A perspective view of an example of a sample layout for a 3D model are shown in item (i) of FIG. 20B. The chips can have a predefined dimension so that the design is constrained to it. The individual chips can be bonded to a circuit board using, e.g., crystal bond at 90° C. Then the chip can be tested directly under a probe-station or wire-bonded to the PCB.

This process can produce reliable interconnections between the three metal layers 909/921/930, which in turn allows the creation of devices having independent electrical and mechanical properties. This independence of mechanical and electrical properties allows the design of a wider array of devices than other multi-user processes. The multi-user process for MEMS devices fabrication integrates a polyimide structural layer with multiple metal layers on a silicon substrate. Well established micro-fabrication techniques can be used throughout the whole process to assure reliability and cost effectiveness. This robust and versatile polymer-metal multi-user MEMS Process (PiMMPs) fabrication process can be applied to applications for out-of-plane compliant structures such as, but not limited to, micro-heaters for gas sensing applications, micro-mirrors with adjustable angle, electrostatic micro-switches, logic gates and Tsang suspension compliant mechanisms with embedded actuators, among others. The high elasticity and thermal resistance of polyimide make it an outstanding structural material for MEMS devices and out-of-plane structures.

Out-of-Plane Platforms with Bimorph Actuation

Many out-of-plane structures are built using in-plane fabrication processes and are then assembled to provide a viable solution to MEMS devices requiring thermal and electrical isolation from the substrate. This isolation improves the performance of a range of different MEMS devices by reducing the coupling, and parasitic loses between the device and substrate. These out-of-plane plates can be manufactured using hinged structures that are assembled to a fixed position using complex locking structures requiring challenging assemblies, or hingeless structures that can be assembled mechanically to a position where they lock themselves by means of a compliant mechanisms such as: buckled cantilever platforms (BCPs) and Tsang suspensions. BCPs are presented that incorporate thermal bimorph actuators in order to enable controlling the angular position of the assembled plate.

Figure 21:
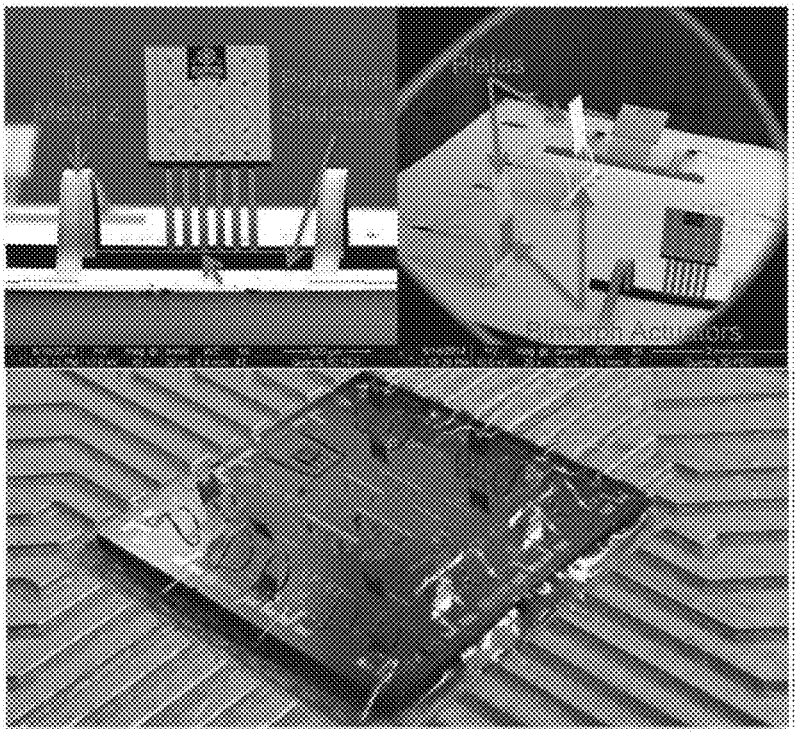
FIG. 21 are images illustrating examples of buckled cantilever platforms (BCPs) with bimorph actuators in accordance with various embodiments of the present disclosure.

FIG. 21 shows images of assembled polyimide BCPs with bimorph actuators. A MEMS thermal bimorph actuator comprises two materials with different coefficients of thermal expansion that generate motion when heated. The mismatch in thermal expansion causes any bi-layered structure (e.g. a beam made of both materials) to undergo longitudinal stress, and bend towards the material with lower thermal expansion coefficient. The top scanning electron microscope (SEM) images of FIG. 21 illustrate cantilever platforms that can include, e.g., a digital transducer array of a DTAL device 203 (FIG. 2) in an out-of-plane position. The bottom optical image of FIG. 21 shows an example of a wired bonded chip that includes the cantilever platforms.

Figure 22:
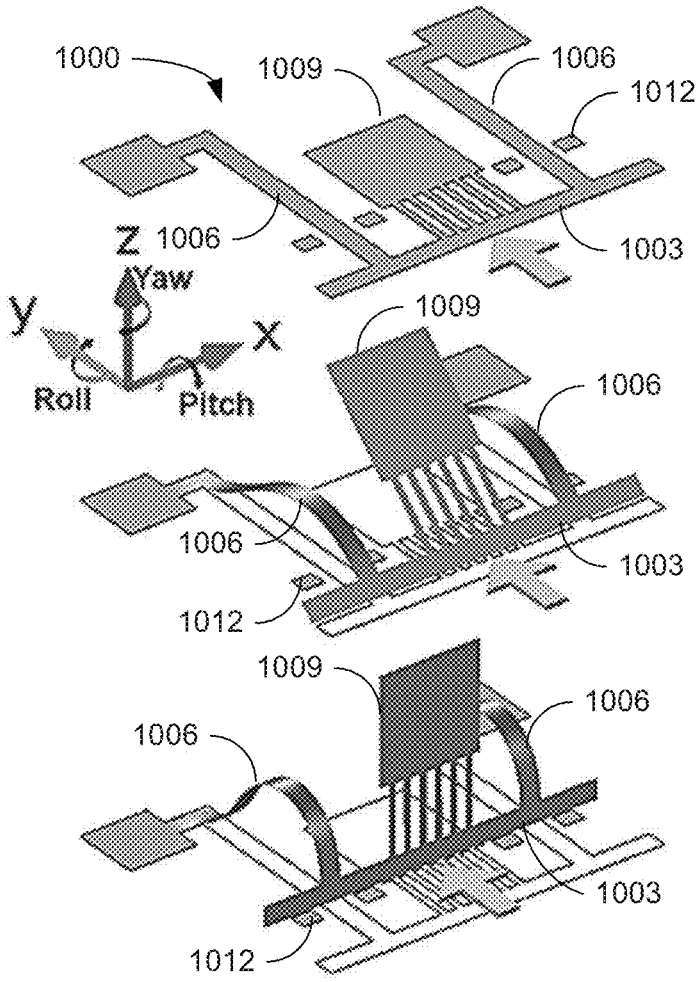
FIG. 22 is a graphical representation illustrating operation of a BCP with bimorph actuators in accordance with various embodiments of the present disclosure.

Referring to FIG. 22, shown is an example of an assembly for a buckled cantilever platform (BCP) 1000 with arrows indicting the actuation of the assembly. The actuation process for BCPs 1000 includes pushing the front edge 1003 of the structure backwards in order to compress the lateral beams 1006 until they buckle out-of-plane. If a plate 1009 is attached between the buckled beams 1006, the actuation process causes the plate to rise from the substrate to a desired position as illustrated in FIG. 22. This process can be performed using a wire bonder tip or a microprobe station needle. To prevent the structure from returning to its original position, a set of anchored structures (stoppers) 1012 can be placed along the sliding path of the moving edge 1003. The final angle of the plate 1009 is dependent on the position of these stoppers 1012 and on the point where the platform is attached to the buckled cantilevers 1006. For example, if the stoppers 1012 are placed at a distance approximately 70% of length of the cantilever 1006, a plate 1009 attached at the tip of the beams will be oriented at 90° or perpendicular to the substrate. Whereas a plate 1009 attached at 60% of the length instead of at the tip will be parallel to the substrate. Although the BCPs can be designed to meet any angle between 0 and 90°, they are assembled to a fixed position which cannot be adjusted after the assembly process.

Many MEMS devices can utilize these out-of-plane platforms. For example, digital transducer array loudspeakers, vertical RF antennas performing with improved efficiency as compared to horizontal antennas, thermal accelerometers taking advantage of the thermal isolation and an out-of-plane assembly, magnetic field induction sensors with three axis sensing, thermally isolated micro-heaters for gas sensing applications and micro-optical benches.

In the case of the MEMS micro-optical bench, alignment of the micro-mirrors can be used to redirect the light in a desired direction. To overcome this challenge, a compliant mechanism can be assembled on top of a rotating drive, with the disadvantage of a complex fabrication process and design. Thermally actuated BCPs with integrated bimorph actuators can perform the angle adjustments with enhanced resolution (e.g., 110 μm/V), and can also be oscillated using an AC voltage supply to expand their use in the development of low frequency scanners like sweeping antennas, and bar code readers. The thermally actuated BCPs can also be used to align a digital transducer array of a DTAL device 203 to help direct the transmitted sound. In addition, the BCPs can be designed and manufactured with fewer microfabrication steps than the above mentioned solution, thus lowering their fabrication cost. The temperature across the BCPs structure during the operation of the thermal bimorph actuators was observed to evaluate any adverse effect on the plate's thermal isolation and further characterization is presented regarding the frequency response of the structures.

Out-of-plane platforms were fabricated using the HDMicrosystems polyimide PI-2611 as the structural material and amorphous silicon (α-Si) as the sacrificial layer. This fabrication process was developed to incorporate three conductive layers that can be interconnected to form sensors and actuators. FIG. 23 shows an example of a fabrication layout of a thermal BCP. The first Cr/Au metal layer 1015 ("Metal 0"), is patterned directly on top of the substrate and it is used to place reliable contact pads for easy wire-bonding between the devices and characterization setup. The second Au/Cr metal layer 1018 ("Metal 1") and third Ni metal layer 1021 ("Metal 2") are used to either connect any transducer manufactured in the out-of-plane plate or to actuate the integrated bimorph actuators. In the example of FIG. 23, the bimorph actuators are built on Metal 2, and when actuated they bend the plate backwards.

In the bimorph actuators, the metal layer 1021 acts as both one of the materials with different coefficients of thermal expansion that compose it (the second one being the polyimide structural layer 1024), and as the heating element that provides the change in temperature. Since the fabrication process allows a metal layer to be deposited on either the top of the polyimide (with Metal 2) or underneath it (with Metal 1), thermal bimorph actuators can be designed to be capable of moving the plate 1009 in both clockwise (CW) and counterclockwise (CCW) directions. Thanks to the versatility of the fabrication process, the proposed BCPs 1000 can be used in a range of different applications where active transducers and movable plates are desired.

The fabrication process comprises six physical layers and seven photolithographic masks (e.g., FIG. 20A). An example of the process is depicted on FIG. 20B, and a detailed description of process parameters has been presented. The processed silicon wafer can be diced in several chips. Note that both metallization layers are connected with "Metal 0" where the contact pads are placed. "Metal 1" connects directly with "Metal 0" whereas "Metal 2" connects to "Metal 0" through "Metal 1". In this way, both metallization layers are independent from each other and can be used to serve different purposes and implementations.

The BCP chips that were fabricated and tested had six bimorph actuator beams with dimensions of 50 μm in width by 500 μm in length, connecting the structure plate (790 μm×750 μm) with the front edge 1003 of the structure. The stoppers 1012 are placed at a distance of 70% of the beam's length, so the plate 1009 will assemble perpendicular to the substrate. This position facilitates the characterization of the plate displacement when the bimorph actuators are operated.

One of the main advantages of the BCPs, when assembled, is their thermal isolation from the substrate which allows a small portion of the BCP to be heated without heating the substrate. For transducers based on thermal principles of operation, this isolation reduces their power consumption and increases considerably their efficiency. A possible problem in the proposed system can be caused by the internal heat transfer from the thermal bimorph actuators to the out-of-plane plate. This could potentially affect the performance of any MEMS device that is designed and placed on the structure. In order to evaluate any adverse effects on the thermal isolation, a thermal characterization was performed, when the thermal bimorph actuators were operated at their maximum power consumption (about 35 μW) using an Optotherm Infrasight MI320 infrared camera.

FIG. 23B shows a front view image of a BCP taken with the thermal imaging camera with the thermal bimorph actuators operating at their maximum power consumption (about 35 μW). The results show a low influence of the bimorph actuation on the temperature plate. The maximum temperature reached by the thermal actuators during operation was approximately 82° C. The plate 1009 maintained a low temperature, reaching a maximum temperature at the bottom (≤35° C.) and remained unaffected at the top (≤22° C.), not compromising in this way the plate's thermal isolation. The heat distribution on the thermal actuators was uniform across the structure width and therefore the plate is also expected to move evenly causing a consistent angular displacement, without torque.

To test and characterize the BCPs with integrated bimorph actuators, a 1 $cm^2$ chip was placed in a mechanically machined chip holder. Wire bonding was then used to connect the various platforms with a voltage source as shown in the top images of FIG. 21. The applied input voltage was gradually increased while measuring the power consumption and plate displacement at each step. The displacement of the plate was measured using an automated image-processing tool implemented in LabView. In this tool, a sequence of DC voltages was input from 0 to 6 V and the drawn current and displacement of the top edge of the plate measured by taking images from the top, and measuring the difference in pixels from a reference position.

Figure 24A:
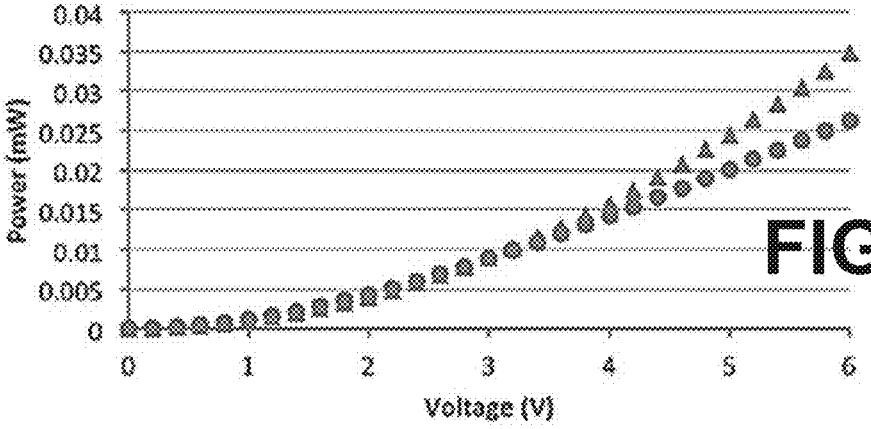
FIGS. 24A through 24C illustrate test results of a fabricated BCP with bimorph actuators in accordance with various embodiments of the present disclosure.
Figure 24B:
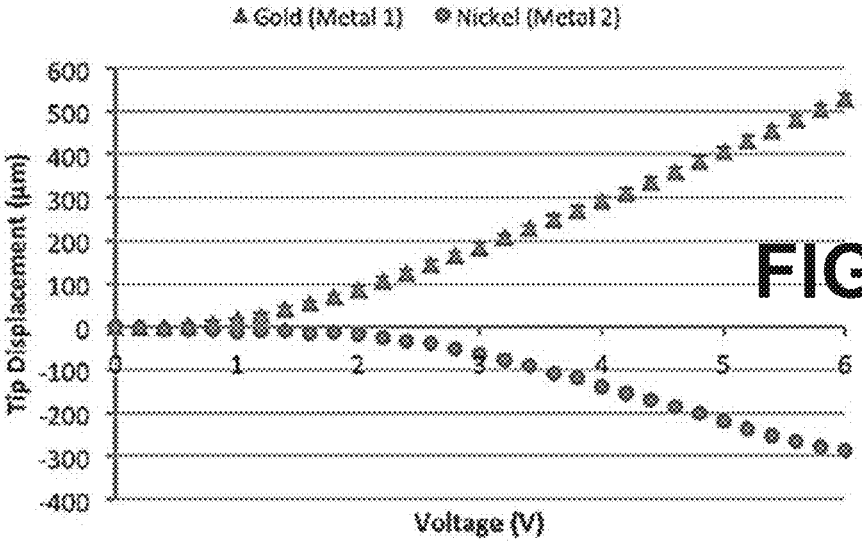

The extracted data is shown in the plots of FIGS. 24A and 24B. FIG. 24A shows the characterization of power consumption and FIG. 24B shows the top edge displacement due to the actuation of the bimorph cantilevers. The data is shown for a device with six bimorph actuation beams, width=50 μm, with gold and nickel conductive layers. Measurements were averaged from six repetitions, with a very low variation (<2.5%). Error bars show the standard variation. Two separate BCPs with integrated thermal bimorph actuators were tested, one using "Metal 1" as the heating element, and the other using "Metal 2". As expected, the platforms with "Metal 1" moved forward (away from the contact pads), whereas the platforms with "Metal 2" move in the opposite direction. In both cases, low power consumption and large displacements were observed. The difference in the metals explains the difference in performance between one direction and the other. If similar displacement is desired then both metallization layers can be deposited from the same material.

Figure 24C:
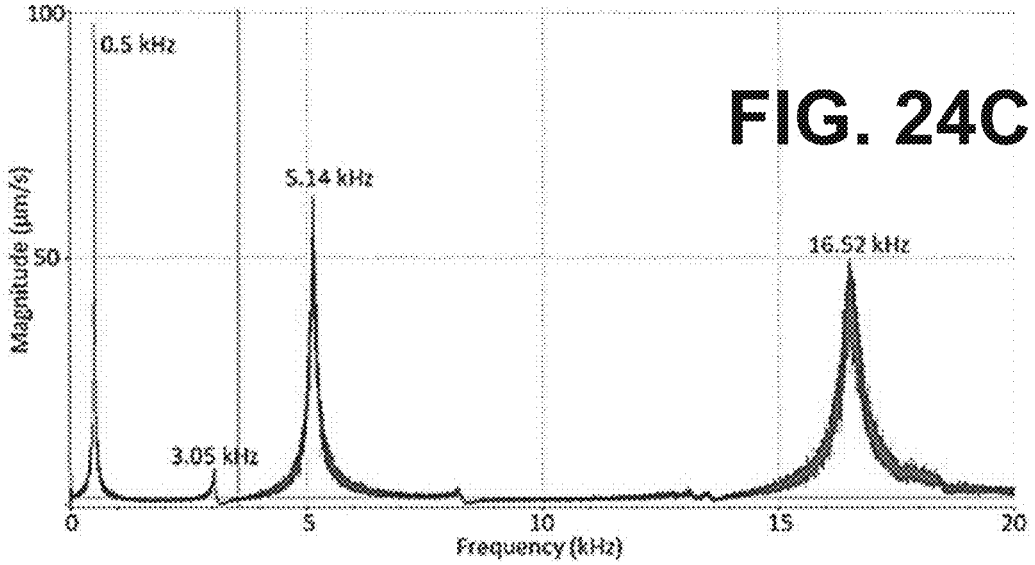

Another parameter to take into consideration when designing motion actuators is the structure's natural frequency. For some MEMS devices, it is desirable to operate them at their resonance frequency because the displacement amplification is often desirable. The natural modes of resonance were measured using a Polytec laser Doppler vibrometer, when white noise was applied at the bimorphs. FIG. 24C shows the frequency response of the structure when actuated by a sinusoidal sweep from 0.010 to 20 kHz. The study was performed using a Polytec MSA-500 Micro System Analyzer. After the analysis, the first mode of resonance was found to be the motion of interest, because the plate oscillates uniformly back and forth. This resonance frequency was found at 500 Hz. Because of the slow response-time inherent to the bimorph thermal actuators, these devices are suitable for applications with low frequency operation like sweeping sensors, DTALs or micromirrors for an optical bench.

A low-power consumption out-of-plane platform with an adjustable bi-directional angle that integrates thermal bimorph actuators has been demonstrated. Due to the high precision (in the nanometer range), control and repeatability of the thermal actuation, these platforms can be used in a range of different MEMS devices that need a reconfigurable out-of-plane position. Thermal imaging was used to determine a low influence in the BCP plate temperature when the thermal bimorphs are actuated at their maximum power consumption. Although the process was not optimized for bimorph actuation, the use of polyimide, and Cr/Au or Ni as bimorph layers has shown interesting results towards the development of BCPs with larger displacements. Since their actuation can be oscillated, many other sweeping applications can benefit from this technology, such as sweeping antennas and bar code scanners.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A method for forming a digital loudspeaker, the method comprising:

forming a silicon oxide layer on a first face of a fixed frame;

forming a common ground layer on the silicon oxide layer;

spinning a piezoelectric layer to extend over the common ground layer;

forming a top electrode layer to extend over the piezoelectric layer; and etching an opening in a second face of the fixed frame until the silicon oxide layer is exposed, wherein the second face is opposite to the first face, wherein the common ground layer and the top electrode layer are configured to act as electrodes to actuate the piezoelectric layer to act as a flexible membrane.

2. The method of claim 1, further comprising:

thermally growing the silicon oxide layer on the fixed frame.

3. The method of claim 1, wherein the step of spinning further comprises:

thermally annealing the piezoelectric layer.

4. The method of claim 1, wherein the common ground layer has a thickness of 300 nm, the piezoelectric layer has a thickness of 250 nm and the top electrode layer has a thickness of 300 nm.

5. The method of claim 1, wherein the silicon oxide layer is sandwiched directly between the fixed frame and the common ground layer.

6. The method of claim 1, further comprising:

patterning the top electrode layer by a lift-off process.

7. The method of claim 6, further comprising:

etching the piezoelectric layer to have a circular shape.

8. The method of claim 1, further comprising:

forming a flexible membrane layer on top of the top electrode layer.

9. The method of claim 1, wherein the piezoelectric layer is shaped as a circle and the opening in the fixed frame is shape as a circle.

10. The method of claim 9, wherein a ratio between (1) a diameter of the piezoelectric material and (2) a diameter of the opening is between 0.8 and 0.9.

11. The method of claim 1, wherein a stack formed by the common ground layer, the piezoelectric layer, and the top electrode layer has four arms that connect to the fixed frame.

12. A method for forming a digital loudspeaker, the method comprising:

thermally growing an etch-stop layer on a first face of a fixed frame;

forming a common ground layer over the etch-stop layer;

forming a piezoelectric layer to extend over the common ground layer;

forming a top electrode layer to extend over the piezoelectric layer; and etching an opening in a second face of the fixed frame until reaching the etch-stop layer, wherein the second face is opposite to the first face, wherein the common ground layer extends over a bottom face of the piezoelectric layer and the top electrode layer extends over a top face of the piezoelectric layer, and wherein the common ground layer and the top electrode layer are configured to act as electrodes to actuate the piezoelectric layer to act as a flexible membrane.

13. The method of claim 12, wherein the etch-stop layer is a silicon oxide layer.

14. The method of claim 12, wherein the step of forming a piezoelectric layer comprises:

spinning a sol-gel material to form the piezoelectric layer; and thermally annealing the piezoelectric layer.

15. The method of claim 12, wherein the common ground layer is made of platinum and has a thickness of 300 nm, the piezoelectric layer has a thickness of 250 nm and the top electrode layer has a thickness of 300 nm.

16. The method of claim 12, wherein the etch-stop layer is sandwiched directly between the fixed frame and the common ground layer.

17. The method of claim 12, further comprising:

patterning the top electrode layer by a lift-off process.

18. The method of claim 17, further comprising:

etching the piezoelectric layer to have a circular shape; and forming a flexible membrane layer on top of the top electrode layer.

19. The method of claim 12, wherein the piezoelectric layer is shaped as a circle and the opening in the fixed frame is shaped as a circle.

20. The method of claim 19, wherein a ratio between (1) a diameter of the piezoelectric material and (2) a diameter of the opening is between 0.8 and 0.9.

* * * * *